US005775040A

United States Patent [19]

Lalvani

[11] Patent Number: 5,775,040

[45] Date of Patent: Jul. 7, 1998

[54] NON-CONVEX AND CONVEX TILING KITS AND BUILDING BLOCKS FROM PRISMATIC NODES

[76] Inventor: Haresh Lalvani, 164 Bank St., Apt. 2B, New York, N.Y. 10014

[21] Appl. No.: 751,507

[22] Filed: Nov. 18, 1996

Related U.S. Application Data

[63] Continuation-in-part of Ser. No. 684,978, Apr. 15, 1991, Pat. No. 5,575,125, which is a continuation-in-part of Ser. No. 282,991, Dec. 2, 1988, which is a continuation of Ser. No. 36,395, Apr. 9, 1987, Pat. No. 5,007,220.

[51] Int. Cl.[6] ..... E04C 2/30

[52] U.S. Cl. ..... 52/311.2; 52/384; 52/DIG. 10

[58] Field of Search ..... 52/DIG. 10, 311.2, 52/384

[56] References Cited

U.S. PATENT DOCUMENTS

| | | | |
|---|---|---|---|
| 4,133,152 | 1/1979 | Penrose | 52/105 |
| 4,343,471 | 8/1982 | Calvert | 52/311.1 X |
| 4,350,341 | 9/1982 | Wallace | 52/311.1 X |
| 4,537,001 | 8/1985 | Uppstrom | 52/311.1 X |
| 4,620,998 | 11/1986 | Lalvani | 52/311.1 X |
| 4,723,382 | 2/1988 | Lalvani | 52/DIG. 10 X |
| 5,007,220 | 4/1991 | Lalvani | 52/311.1 X |
| 5,036,635 | 8/1991 | Lalvani | 52/DIG. 10 X |

*Primary Examiner*—Christopher Kent

[57] ABSTRACT

A family of non-convex and convex tiles which can be tiled together to fill a planar surface in a periodic or non-periodic manner. The tiles are derived from planar space frames composed of a plurality of regular p-sided polygonal nodes coupled by a plurality of struts. p is any odd number greater than three and an even number greater than six. The nodes and struts, along with the areas bounded by them, make up a tiling system. In addition, the lines joining the along the center lines of the struts define a large family of convex and non-convex tiles. The convex tiles include zonogons, and the non-convex tiles include tiles with one or more concave vertices including singly-concave, bi-concave (doubly-concave), multiply-concave and S-shaped tiles. The tiles can be converted to 3-dimensional space-filling blocks. When these blocks are hollow and inter-connected, architectural environments are possible. Other applications include tiles for walls, floors, and various architectural and other surfaces, environments, toys, puzzles, furniture and furnishings. Special art pieces, murals and sculptures are possible.

27 Claims, 26 Drawing Sheets fig. 18
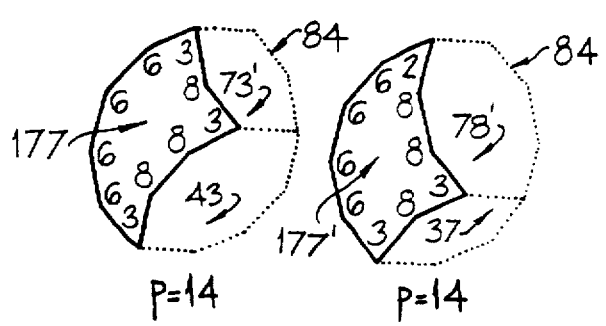
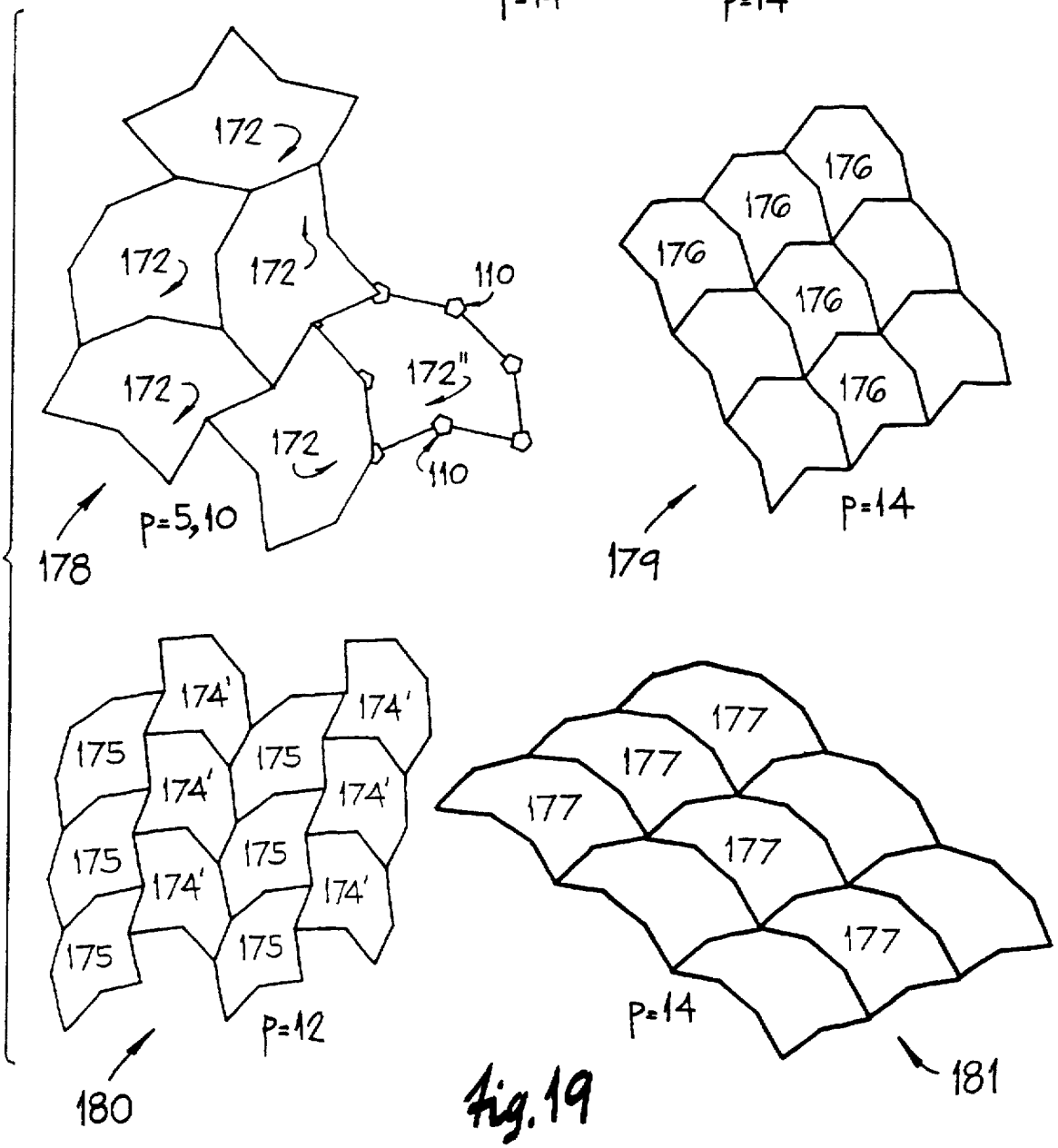
fig. 19

NON-CONVEX AND CONVEX TILING KITS AND BUILDING BLOCKS FROM PRISMATIC NODES

This application is a Continuation-in-Part of the application Ser. No. 07/684,978 filed Apr. 15, 1991, now patented as U.S. Pat. No. 5,575,125, dated Nov. 19, 1996, which is a Continuation-in-Part of Ser. No. 07/282,991 filed Dec. 2, 1988, which is a continuation of Ser. No. 07/036,395 filed Apr. 9, 1987, now patented as U.S. Pat. No. 5,007,220 dated Apr. 16, 1991 (hereafter referred to as the "parent" application).

BACKGROUND OF THE INVENTION

Modular building systems are of great interest in architecture and building technology, both on earth and in outer space. The advantages go beyond mere novelty of building form or space structure configurations. Besides the integration of geometry and structure, the economy due to few prefabricated elements, easy assembly due to repetitive erection and construction procedures are among the more attractive goals. Among the modular building systems, a system that permits both periodic and non-periodic configurations has the advantage of versatility over systems that do one or the other. In addition, the random-look of non-periodic configurations provide greater visual interest if carried out with an aesthetic sensitivity. Each designer, using a set of tiles from the present invention, could make up his or her own specific design different from others, each new and unique. This is an advantage absent in the periodic tiles and in rule-based non-periodic tiles. In addition, the tiles are fun to play with. Further, if the same pieces can be re-arranged in a variety of periodic as well as non-periodic ways, the designer is afforded a great flexibility in the design process.

In some cases, as in the case of masons who lay tiles in architectural environments, the freedom to design his or her own signature tiling pattern exists as a possibility. Another example would be astronauts assembling space structures in orbit. This advantage is inter-active, and designs can be modified as they are being realized. This is a possible advantage that can can be extended to robotic and computer-aided assembly of modular building systems.

This patent focusses mainly on various shapes of tiles and the tiling configurations generated by using these tiles. The tiles can be converted to upright or inclined prisms of any height. Such prisms provide alternative blocks and bricks for physical environments, architecture, art and sculptural objects, toys, games and puzzles. When only the outside surface planes of the prisms are used, and approporiately designed openings are made in these planes, usable and habitable architectural spaces can be defined.

The prior art in this field includes numerous U.S. patents. U.S. Pat. No. 1,474,779 to A. Z. Kammer discloses periodic tiling based on mirror-symmetric even-sided polygons derived from regular polygons. U.S. Pat. No. 4,133,152 to R. Penrose discloses a non-periodic tiling composed of two rhombic tiles based on the pentagon. U.S. Pat. No. 4,223,890 to A. Schoen discloses dissections of regular polygons into rhombii and singly-concave hexagons (i.e. a non-convex polygon with one concavity as described later in this application). U.S. Pat. No. 4,350,341 to Wallace discloses periodic and non-periodic patterns composed of odd-sided singly-concave polygons. U.S. Pat. No. 4,620,998 to H. Lalvani discloses periodic and non-periodic tilings composed of mirror-symmetric crescent-shaped tiles.

H. Lindgren's book 'Recreational Problems in Geometric Dissections & How to Solve Them', (Dover, 1972), presents numerous examples of periodic tilings composed of convex and non-convex tiles obtained from dissections of regular polygons. The book, 'Tilings and Patterns' by B. Grunbaum and G. Shephard, (W. H. Freeman, 1987), presents a large catalog of tilings. The relevant work in this book, in addition to Lindgren and Penrose (already cited), includes a non-periodic tiling based on Harborth's construction and composed of mirror-symmetric hexagons derived from a pentagon (p.52), Amman's non-periodic tiling composed of a square and a 45° rhombus (p.556). In addition, D. R. Simonds (1977, 78) and G. Hatch (1978) in the journal Mathematics Teaching show examples of central and spiral tilings composed of "reflexed" 5-sided, 7-sided and 9-sided polygons. J. Baracs in Structural Topology journal (1979) discloses periodic tilings using convex zonogons.

Prior art, except for a few cases which are excluded in this application, does not teach periodic, non-periodic and central tilings based on 'non-regular zonogons' and non-convex polygons derived from them, where all polygons are based on the concept of integer multiples of central angles of regular p-sided polygonal nodes. Non-regular zonogons are even-sided convex polygons with a two-fold center of symmetry, and thus exclude the regular polygons which can be termed 'regular zonogons'. The two-fold symmetry requires the edges (and angles) of non-regular zonogons to occur in pairs of opposite and parallel sides (and angles).

SUMMARY OF THE INVENTION

The shapes of the tiles and the configurations of the tiles, or tiling patterns (also termed 'tilings') based on regular p-sided prismatic nodes are described in detail. Both periodic, non-periodic and tilings with central symmetry, termed 'central tilings', are described. In some of the non-periodic tilings disclosed here, the tiles fit randomly, and no attempt has been made to demonstrate any rules which force a non-periodicity. Such rules, which include forcing the tiles to fill the plane non-periodically, are of great mathematical interest. From a designer's point of view, random tilings, without any prescribed rules of how to tile the surface, have a built-in design advantage in that they permit the designer, or the person constructing the tilings in architectural environments, an enormous freedom to improvise as tiles are being laid, or as tiling sequences are being designed. Some of this requires trial-and-error, but as long as the angles of the tiles gaurantee a possible fit, the possibilities are limitless.

The common theme in the large variety of tile shapes and the tilings described herein is that the interior (and exterior) angles of the tiles are integer multiples of the central angles of a regular p-sided polygon. The p-sided polygon corresponds to the regular p-gonal face of the p-sided prismatic nodes described in the parent application. Here the polygonal areas bound by the nodes and struts, or alternatively defined by the center lines of the struts, lead to shapes of tiles. This will become clear with examples described later. From the large number of possible tilings obtained by using this technique, several classes of known tilings are excluded in the present disclosure.

DRAWINGS

Referring to the drawings which are a part of this disclosure:

FIG. 18 shows two examples of bi-concave decagons obtained by subtracting a hexagons and an adjacent octagon from a dodecagon.

FIG. 19 shows examples of periodic and non-periodic tilings with various biconcave (doubly-concave) polygons from FIGS. 17 and 18.

DETAILED DESCRIPTION OF THE INVENTION

There are two ways to obtain tilings from space frames made of p-sided regular prismatic nodes. The first method is more obvious by which planar space frames, i.e. single layers of the space frame, are directly constructed as a tiling pattern composed of 'node-tiles' which occupy the node positions, 'strut-tiles' which replace the strut, and polygonal 'infill-tiles' which fill the area bounded by node-tiles and strut-tiles. The second method is less obvious and was already disclosed in the parent application in FIG. 25. To obtain tilings by this method, the node shapes are "shrunk" to a point and the struts are shrunk to an edge. In doing so, the polygonal areas bounded by the nodes and struts become planar polygonal tiles. The vertices and edges of the tiles correspond to the nodes and struts of the space frame, and the angles between the edges of the tiles are same as the angles between the struts meeting at a prismatic node. This way a single layer from the prismatic node space frame system can be directly converted to a tiling system.

Tiling patterns obtained by the second method are described. These include periodic, non-periodic and tilings with central symmetry. Periodic tilings fill a planar surface by a translational symmetry in two directions. Tilings with central symmetry have a p-fold or a (p/2)-fold center of symmetry, and the tiling pattern radiates outwards from this center. Non-periodic tilings disclosed here are of two additional types: the first type has a row of tiles which fit sided-by side in a non-periodic sequence and this entire row is then repeated with a translational symmetry in the second direction. Such a non-periodic tiling is linearly non-periodic. The second type has no translational symmetry in any direction. These could be random, could have local order, or be based on certain plane-filling rules.

In describing the tilings, the regular p-sided prismatic nodes are thought of as regular p-sided polygons instead of prisms. It is thus convenient to describe the face angles (interior angles between adjacent edges) of the tiles in terms of the central angle A of a regular p-sided polygon. The central angle A, the angle subtended by the edge of the regular polygon at its center, equals 360°/p and is also the supplementary angle of the face angle. The angles of all tiles described herein, both convex and non-convex, can be described as integral multiples of angle A. For convenience, the face angles of the polygons will be given in terms of integer only, dropping the A. This integer will be referred to as the 'angle-number'. The exact angle can be calculated by multiplying the angle-number by A. This usage will become clear with an example.

Figure 1:
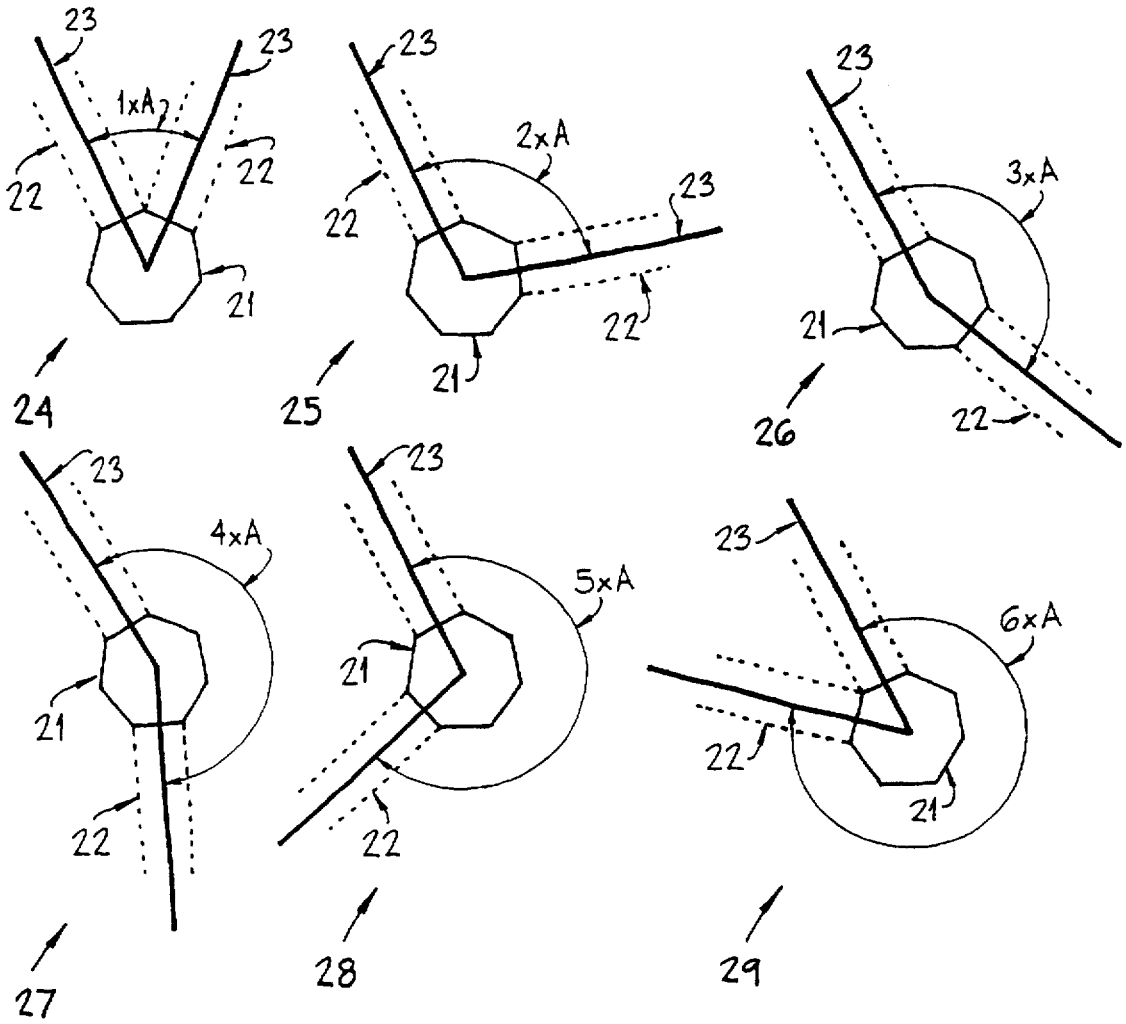
FIG. 1 shows the concept of deriving a vertex of a polygonal tile from a pair of struts meeting at a node; the concept of 'angle-number's' (defined in the text) is also introduced here.

FIG. 1 shows the example of different angles obtained from a single regular polygon, in this case the heptagon 21, i.e. p=7 case. The regular heptagon corresponds to the heptagonal prism node in the parent application, and the "strut" radiating from this node is shown as a pair of dotted lines 22. The edge 23 (shown heavy) is obtained by shrinking the strut. The six illustrations 24–29 show six distinct angles between a pair of edges which meet at the center of the heptagonal node. In illustration 24, this angle equals A. In the remaining illustrations 25–29, the angle is 2A, 3A, 4A, 5A and 6A, respectively. The angle-numbers for the six angles are thus 1, 2, 3, 4, 5 and 6. Since p=7, A=360/7=51.428571 . . . degrees or approximately 51.49°, and the other five angles are twice, three times, four, five and six times this angle. Similarly, the angles from other values of p can be derived.

Figure 2:
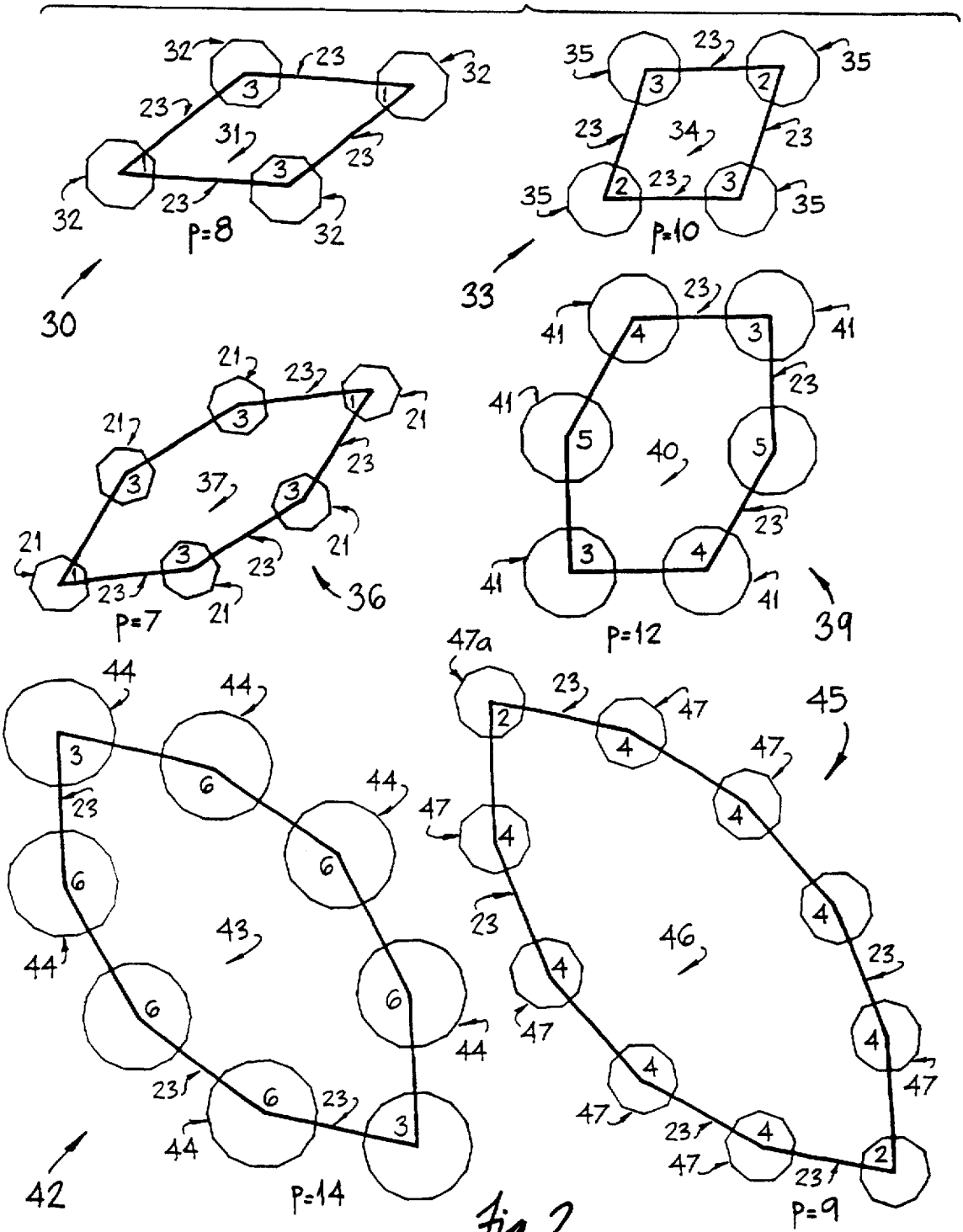
FIG. 2 shows six examples of convex zonogons, including two rhombii, obtained from various p-sided polygonal nodes.

In FIG. 2, six examples of convex zonogons are shown. All six examples are composed of edges 23 but are based on different regular polygonal nodes. In some cases, the number of sides is also different. The values of p is indicated with each example. The face angles for each zonogon are indicated by an integer placed inside the polygon at each vertex; the value of this integer can be visually checked by counting the number of edge segments of the polygonal node that are contained within the zonogon at that vertex. As in the previous case, all integers have to be multipled by A to obtain the exact angle.

Illustration 30 shows a rhombus 31 from the octagonal node 32 (p=8 case) with interior angle-numbers 1 and 3. Illustration 33 shows a different rhombus 34 from the decagonal node 35 (p=10 case) with interior angle-numbers 2 and 3. Illustration 36 shows a hexagon 37 from heptagonal node 38 (p=7); its interior angles are represented by the integers 1 and 3. The illustration 39 shows the hexagon 40 from p=12 nodes with interior angle-numbers 3,4 and 5. The illustration 42 shows an octagon 43 from p=14 nodes and has interior angle-numbers 3 and 6. The decagon 46 in illustration 45 is obtained from p=9 nodes and has interior angle-numbers 2 and 4; the nodes at the two acute vertices are marked **47*a* and 47*b*. All zonogons in this figure have a two-fold symmetry of rotation along with two mirror planes except the hexagon 40** which has a 2-fold symmetry without mirror planes. These two symmetry types characterize all convex zonogons after excluding even-sided regular polygons.

Figure 3:
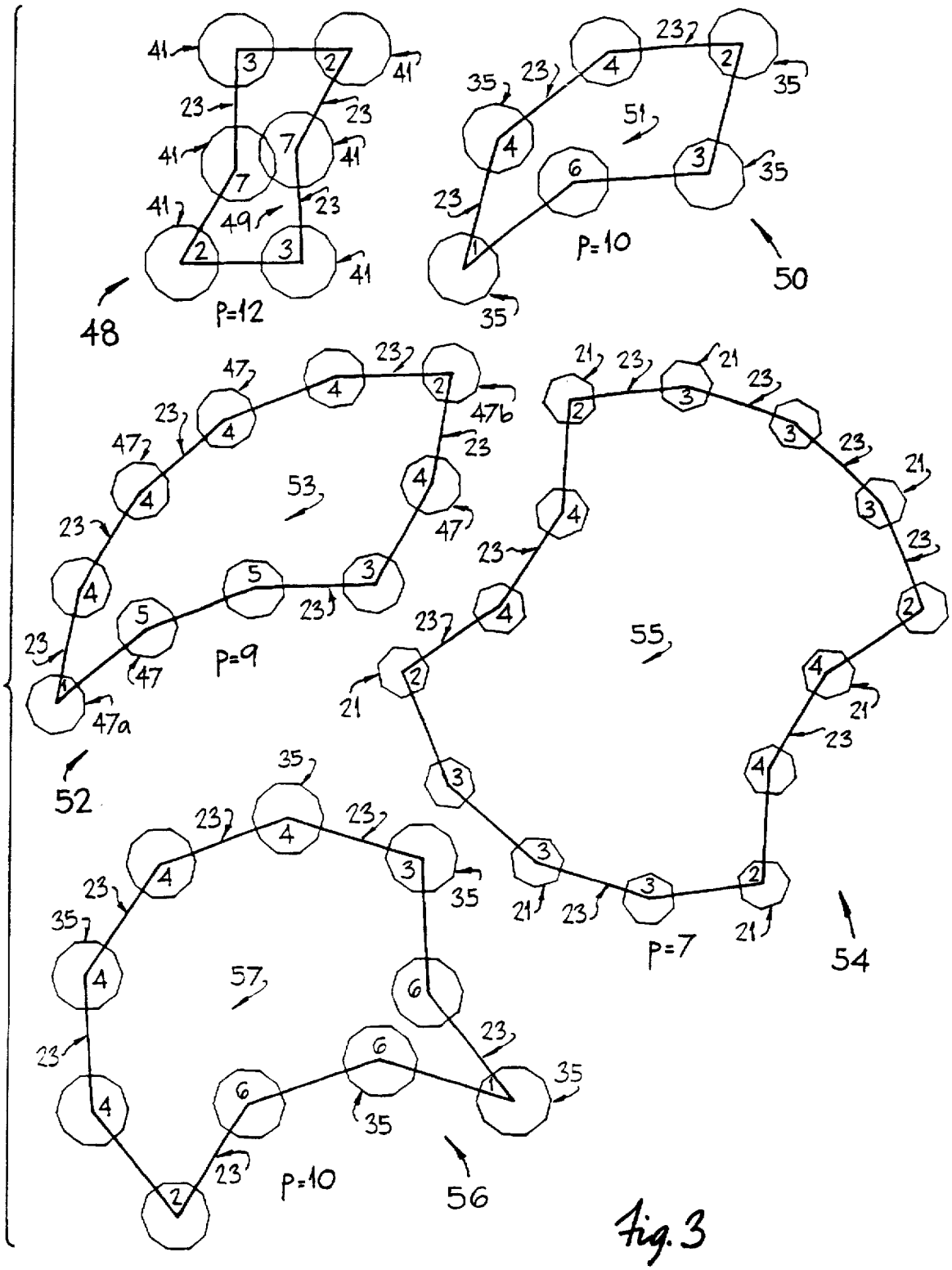
FIG. 3 shows five examples of non-convex polygons obtained from various p-sided polygonal nodes.

FIG. 3 shows five examples of even-sided non-convex polygons, also composed of edges 23 and derived from various regular polygonal nodes. Illustration 48 and 50 show two different types of non-convex hexagons, illustrations 52 and 56 show two different types of non-convex decagons, and illustration 54 is a non-convex 14-sided polygon. Non-convex polygons can be derived by subtracting (removing) a convex polygon from another convex polygon. Different non-convex polygons can be described in terms of the number of concave vertices in the polygon, where the angle number at each concave vertex is greater than p/2.

Illustration 48 is a 'bi-concave' (or doubly-concave or 2-concave) hexagon 49 with a 2-fold rotational symmetry based on p=12 nodes and interior angle-numbers 2, 3 and 7. It can be derived from 39 and has two concave vertices located in opposite positions. Illustration 50 is an asymmetric singly-concave hexagon 51 from p=10 nodes and interior angle-numbers 1,2,3,4 and 6. Illustration 52 is a singly-concave decagon 53 based on p=9 nodes and interior angle-numbers 1,2,3,4 and 5. It has two concave vertices and can be derived from 45 with which it shares the nodes **47*a* and 47*b*. Illustration 54 is a 14-sided bi-concave polygon 55 based on p=7 nodes and can be obtained from a regular 14-sided polygon. It has a 2-fold symmetry with two mirror planes, its interior angle-numbers are 2, 3 and 4, and it has four concave vertices occuring in two distinct sets. Illustration 56 shows an asymmetric bi-concave decagon 57** with p=10 nodes. It can be obtained from a regular decagon and its interior angle-numbers are 1,2,3,4 and 6, and it has three concave vertices occuring in two sets, one set having two concave vertices and the other having just one.

The sum of the interior angle-numbers, I, of both convex and non-convex even-sided polygons obtained from p-sided polygonal nodes are integer multiples of p. This is given by the simple relation l=((m−2)/2)p.A, where m is the number of sides of an even-sided convex or non-convex polygon, and where p is any number greater than 2. This is summarized in Table 1.

TABLE 1

| no.of sides of even-sided polygonal tile # m | sum of interior angle-numbers as multiples of A * l |
|---|---|
| 4 (rhombii) | p |
| 6 (hexagons) | 2p |
| 8 (octagons) | 3p |
| 10(decagons) | 4p |
| 12(dodecagons) | 5p |
| 14(tetrakaidecagons) | 6p |
| m-gon | ((m − 2)/2)p |

# includes both convex and non-convex tiles
* A = 360°/p, where p equals the no. of edges of p-sided regular polygonal node.

Figure 4:
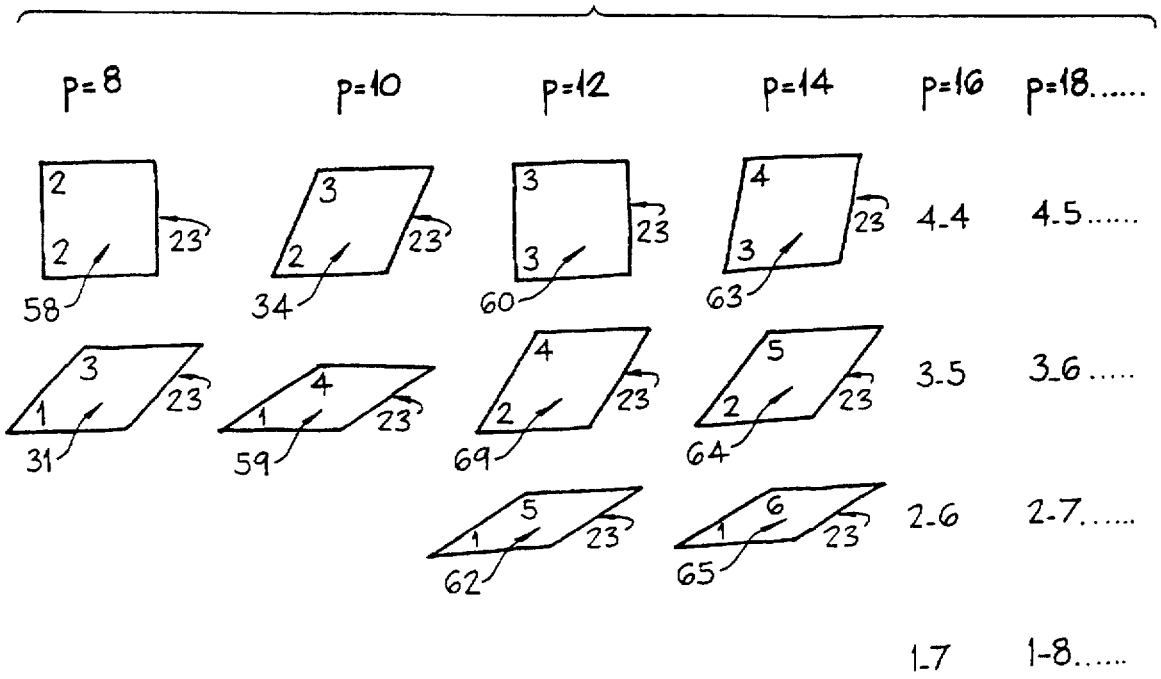
FIG. 4 shows a table of rhombii derived from different values of p. Rhombii from p=8,10, 12, 14, 16, 18 . . . are shown.

FIGS. 4–8 show a partial listing of convex zonogons derived from p-sided polygonal nodes and composed of edges 23. The figures are in vertical columns and list various polygons from even values of p. The rhombii (m=4) are shown in FIG. 4, the hexagons (m=6) in FIG. 5, the octagons (m=8) in FIG. 6, the decagons (m=10) in FIG. 7 and the 12-sided zonogons (m=12) in FIG. 8. In each figure, the polygonal nodes are not shown. The interior angle-numbers at the vertices on only one half of the zonogons are indicated by integers since the other half is the same due to the 2-fold symmetry of non-regular zonogons. From these angle-numbers, the precise angles for each zonogon can be obtained by multplying the integers with A. The figures shown are part of an infinite number of tables, where each figure shows a finite portion of a separate infinite table. In each figure, zonogons for p=8,10,12 and 14 only are shown, and the figures can be extended fo higher values of p. Similarly zonogons with higher values of m can be shown in additional figures.

In FIG. 4, p=8 column shows two rhombii 58 and 31 (the latter was shown earlier in illustration 30 of FIG. 2), the column p=10 also shows two rhombii 34 and 59 (the former was also shown earlier in illustration 33 of FIG. 2), the columns p=12 and 14 show three rhombii each, 60–62 and 63–65, respectively. The sum of interior angle-numbers, I, in each column equals p, and the sum of interior angles equals p.A. Since the opposite angles in each rhombus are equal, each rhombus can be characterized by a pair of angle-numbers or integer-pairs. Thus in columns p=16 and 18, only the angle-number pairs are given as integer-pairs. Clearly, all distinct pairs of integers which add up to p/2 give a list of all possible rhombii. Note that the rhombii can only be constructed from even-sided polygonal nodes. However, in the case of higher zonogons with even angle-numbers, odd-sided nodes with p/2 sides (where p is even) can be used.

Figure 5:
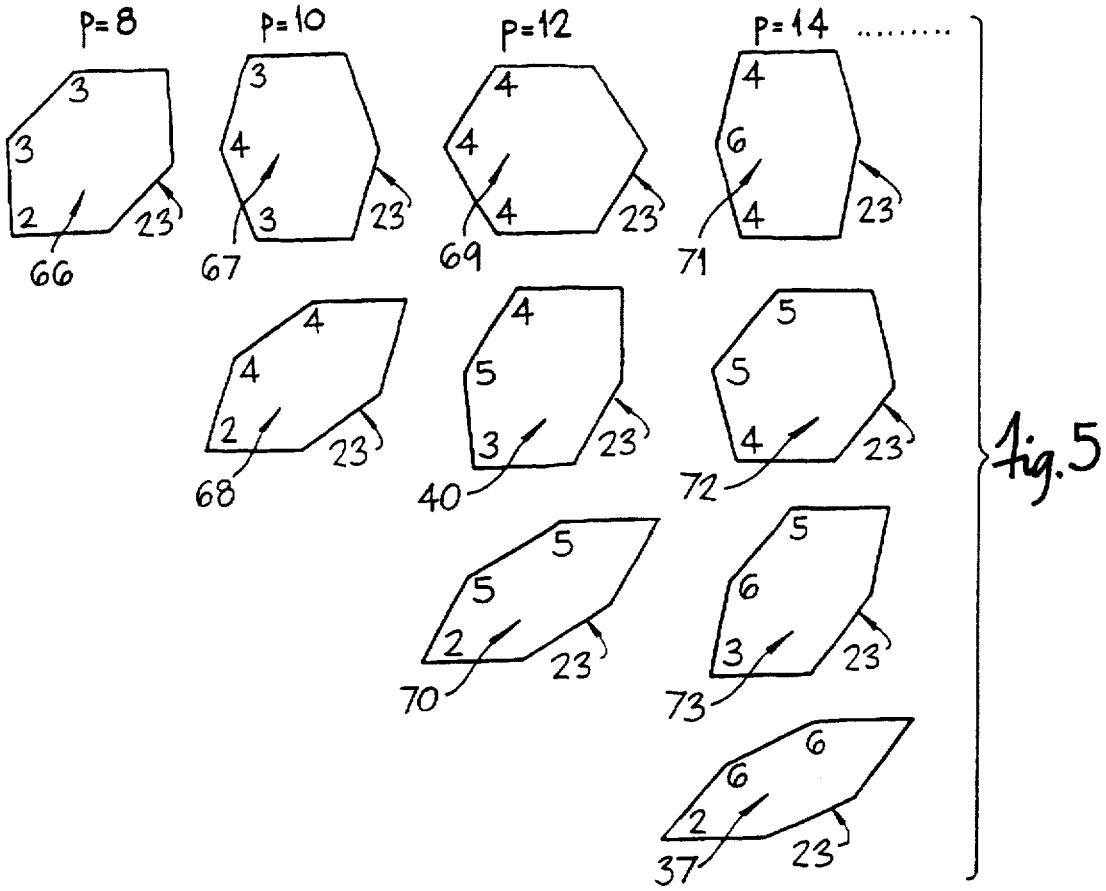
FIG. 5 shows a table of convex hexagons derived from p=8,10,12,14 . . .

In FIG. 5, all hexagons (m=6) for the even cases p=8 through 14 are shown. The three angle-numbers are given for each, and the remaining three are the same by symmetry. The sum of interior angles equals 2 p.A. All hexagons, and all higher zonogons, can be decomposed into rhombii of FIG. 4. All hexagons with even angle-numbers can also be constructed from odd-sided polygonal nodes with p/2 sides. Thus under column p=10, the hexagon 68 can also be constructed from a regular pentagonal node. 69, under column p=12, can also be constructed from a regular hexagonal node, and the hexagons 71 and 37, p=14, can also be constructed from heptagonal nodes. The hexagon 37 was shown earlier in ilustration 36 of FIG. 2.

Figure 6:
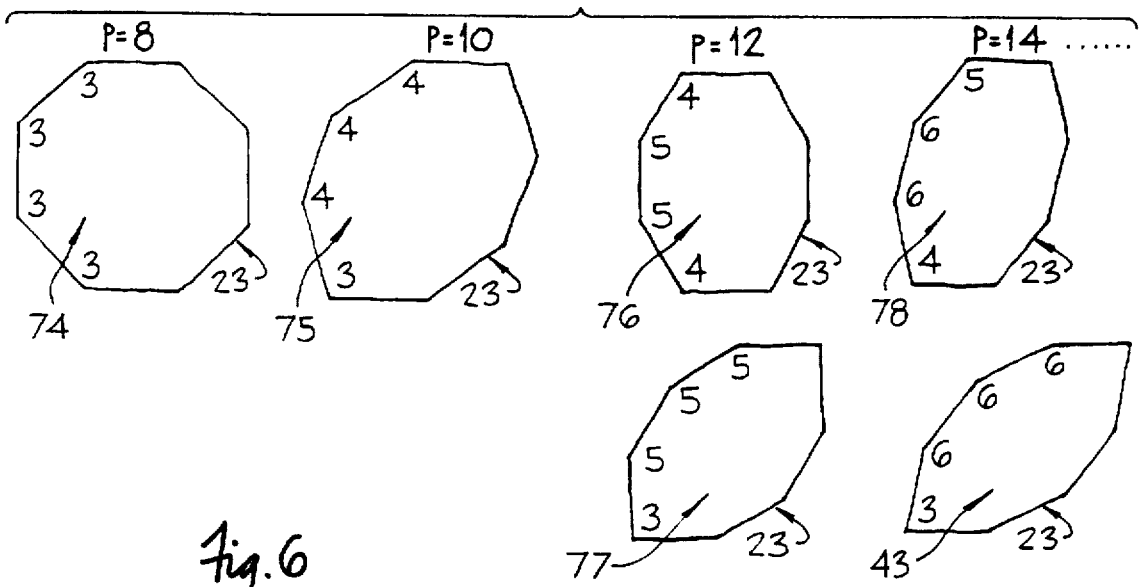
FIG. 6 shows a partial list of convex octagons from p=8,10,12,14 . . .

FIG. 6 shows a partial list of octagons (m=8) for p=8 through 14. The sum of interior angles equal 3 p.A. None of the octagons shown can be constructed from (p/2)-sided nodes. The octagon 43, p=14, was shown earlier in illustration 42 of FIG. 2.

Figure 7:
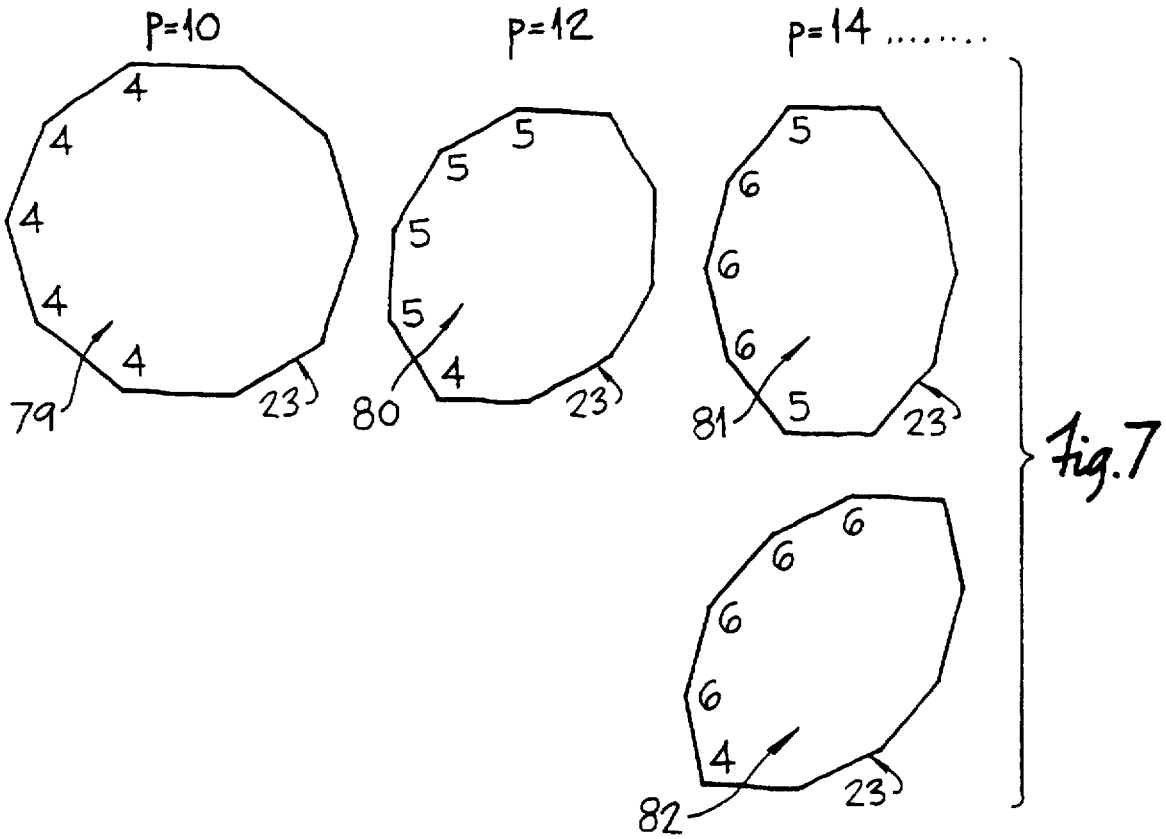
FIG. 7 shows a partial list of convex decagons from p=10, 12, 14, . . .

FIG. 7 shows a partial list of decagons (m=10) for p=10,12 and 14 cases. The sum of interior angles equals 4 p.A. The decagon 82, p=14, can also be constructed from heptagonal nodes.

Figure 8:
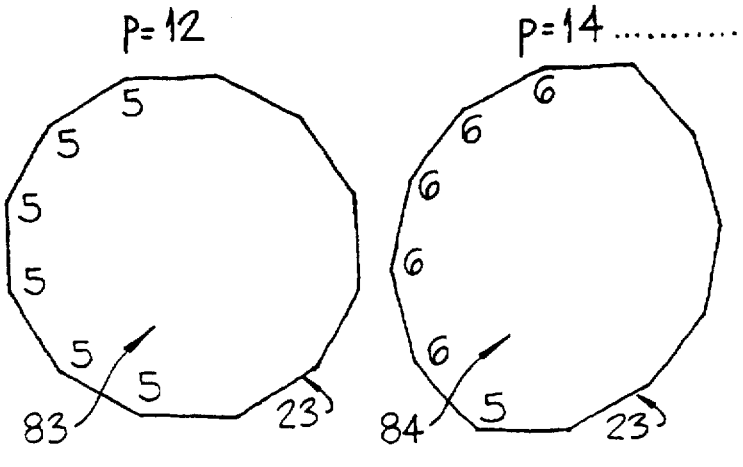
FIG. 8 shows a partial list of convex dodecagons from p=12, 14, . . .

FIG. 8 shows a partial list of 12-sided zonogons (m=12) from p=12 and 14 only. The sum of interior angles equals 5 p.A. Here again, dodecagons with even angle-numbers can be constructed from (p/2)-sided regular polygonal nodes. Similar figures can be shown for all higher values of m.

Figure 9:
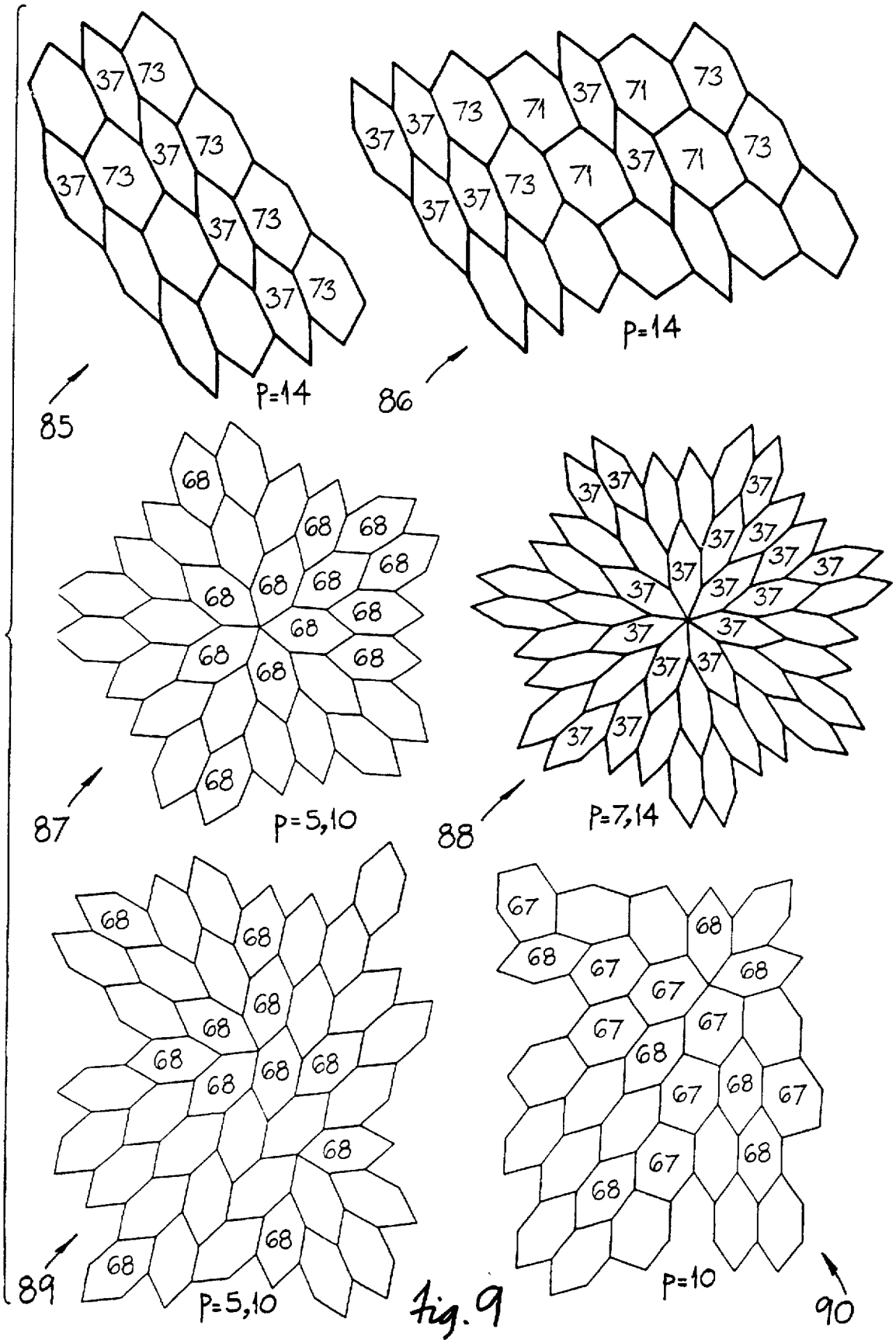
FIG. 9 shows various periodic, central and non-periodic tilings from convex hexagons.

FIG. 9 shows examples of periodic and non-periodic tilings patterns using convex hexagons. Tiling pattern 85, p=14, is a periodic tiling composed of two hexagons 37 and 73. Tiling 86, p=14, is non-periodic and is composed of three different hexagons 37, 71 and 73 arranged in rows. Tiling 87, composed of hexagons 68 from p=5 or p=10 nodes, has central 5-fold symmetry and is based on FIG. 6 of the parent application. Tiling 88, p=7 or 14, is a central tiling with 7-fold symmetry composed of hexagons 37. Similar radial patterns which radiate symmetrically from the center and have mirror symmetry can be obtained from other hexagons. Tiling 89, p=10, is a non-periodic tiling using a single hexagon 68. 90, also p=10, is a non-periodic tiling using two hexagons 67 and 68.

Figure 10:
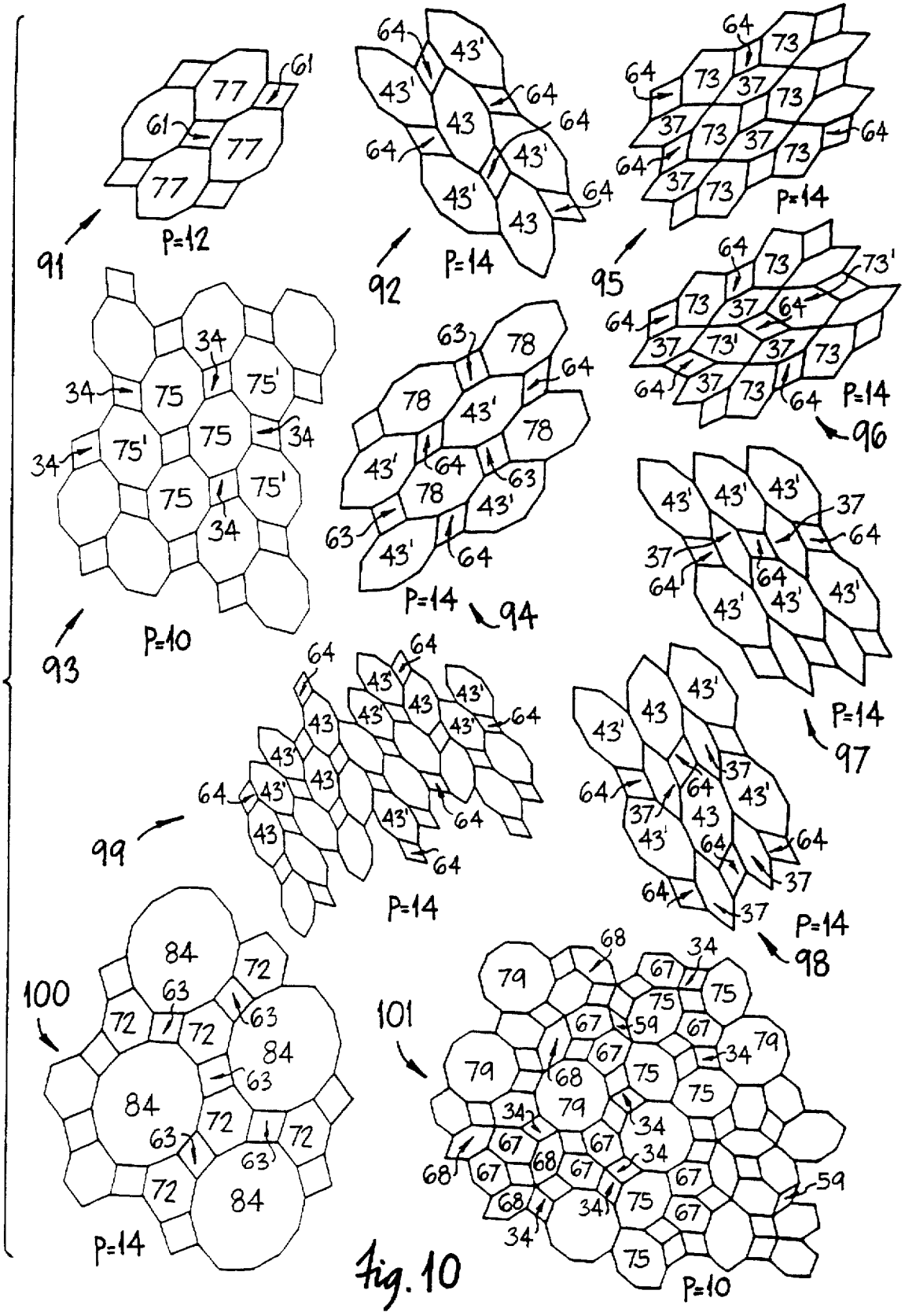
FIG. 10 shows various periodic and non-periodic tilings from various convex zonogons.

FIG. 10 shows eleven examples of tilings with convex zonogons from the p=10,12 and 14 cases.

Tilings 91–94 are examples that use octagons and rhombii in a periodic manner. Tiling 91, based on p=12, has a simple translation along two directions and uses octagons 77 and rhombii 61. Tiling 92, based on p=14, uses octagons 43 and 64 in a zig-zag manner. It has glide reflection, and uses right-handed and left-handed octagonal zonogons which are indicated by 43 and 43'. Tiling 93 is similar to 92 but based on p=10, and uses octagons 75 and 75', and rhombii 34. Tiling 94, based on p=14, uses two types of octagons 43' and 78, and two types of rhombii 63 and 64, in an alternatingly periodic manner.

Tilings 95 and 96, both based on p=14 nodes, are periodic and composed of hexagons and rhombii. Tiling 95 has hexagons 73 and 37, and rhombii 64, used in a two-directional translation. Tiling 96 has mirror planes and a glide reflection, and is composed of hexagons 37, 73 and 73', and rhombii 64.

Tilings 97 and 98, also p=14 cases, are composed of octagons, hexagons and rhombii. While 97 shows simple translation with hexagons 43' and 37, and rhombii 64, the tiling 98 has mirror planes and glide reflection. The latter also has the hexagon 43, the mirror-image of 43'.

Tiling 99 is a non-periodic example based on p=14 and is composed of octagons 43 and 43', and rhombii 64. It is composed of parallel rows of octagons 43 and rhombii 64 which alternate randomly with parallel rows of octagons 43' and rhombii 64.

Tiling 100, based on p=14, is a periodic tiling composed of dodecagons 84, hexagons 72 and rhombii 63.

Tiling 101, based on p=10, is a non-periodic tiling composed of all the convex zonogons from 10-sided nodes. The regular decagons 79, the octagons 75, the two hexagons 67 and 68, and the two rhombii 34 and 59 are tiled randomly. Similar tilings which use all zonogons, including the regular zonogons, derived from any p-sided nodes are possible.

Figure 11:
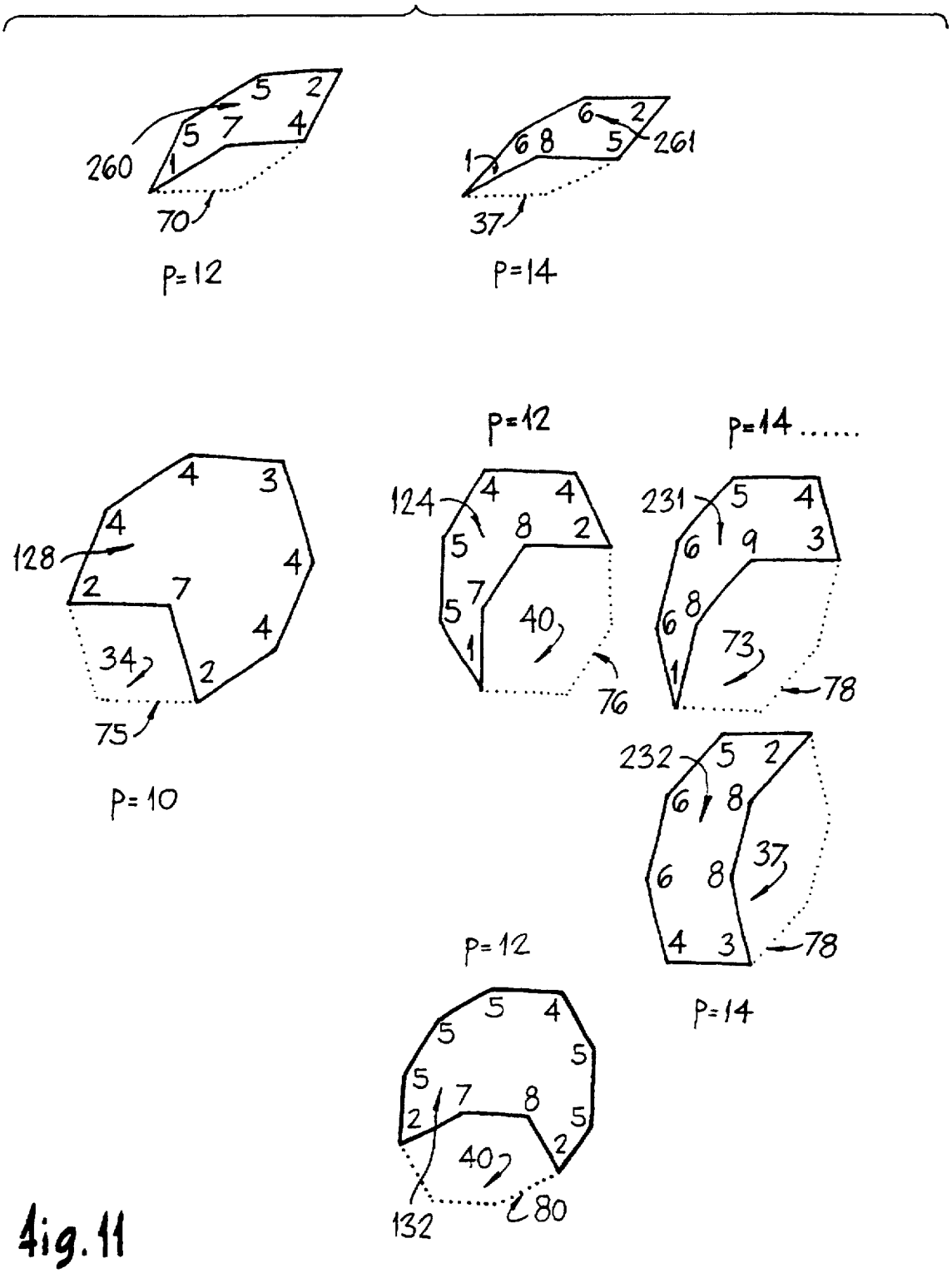
FIG. 11 shows an assortment of singly-concave polygons with 6, 8 and 10 sides.

FIG. 11 shows an assortment of singly-concave crescent-shaped polygons. The tilings with singly-concave polygons are the subject of a companion patent application Ser. No. 07/684,978, another division of the parent application. Singly-concave tilings can be combined with doubly-concave and other multiply-concave tilies as well as convex tiles. The asymmetric hexagonal crescents 260 and 261, from p=12 and 14 polygonal nodes, have a single concave vertex each and are obtained by removing a rhombus from the respective source hexagons 70 and 37. The octagonal crescent 128, p=10 case, has a single concave vertex and is obtained by removing the rhombus 34 from the octagon 75. The p=12 octagonal crescent 124 has two concave vertices and is obtained by removing the hexagon 40 from the octagon 76. The p=14 crescents 231 and 232 are obtained from the octagon 78 by removing the hexagons 73 and 37, respectively. The p=12 decagon 132 is obtained by removing the hexagon 40 from the decagon 80.

FIGS. 12–16 show two classes of doubly-concave polygons with a 2-fold symmetry. Such tiles have a rotational symmetry in most cases though some are mirror-symmetric. They are derived from convex zonogons by removing smaller zonogons (i.e. with fewer sides) from two opposite sides. Consequently, the two sets of concave vertices are located on the opposite sides.

Figure 12:
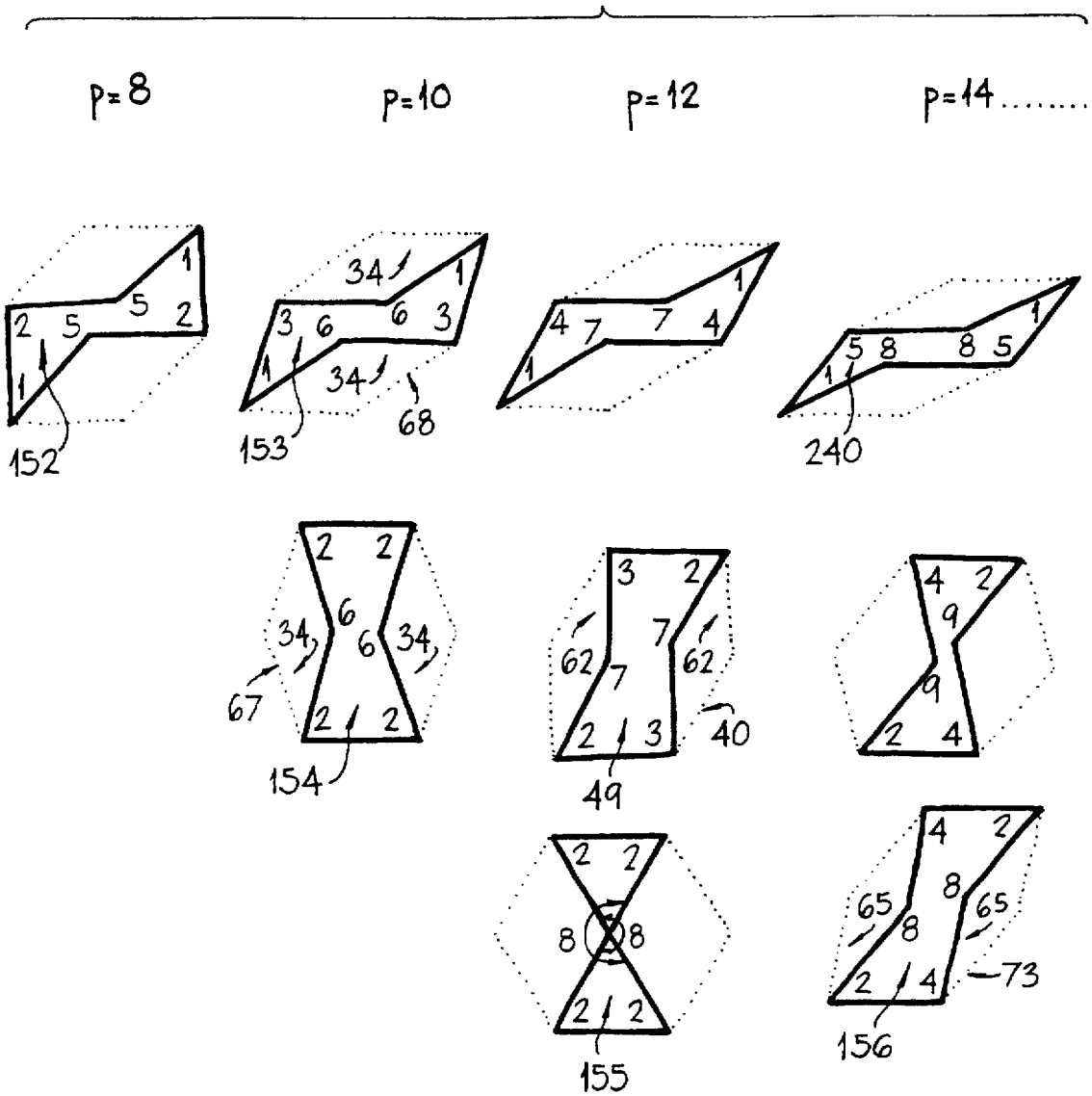
FIG. 12 shows a partial list of biconcave (doubly-concave) hexagons with a 2-fold symmetry and two concave vertices obtained by removing two rhombii from the opposite vertices of convex hexagons.

FIG. 12 shows biconcave (doubly-concave) hexagons obtained by removing rhombii of FIG. 4 from the hexagons of FIG. 5. For example, under p=10, the non-convex hexagon 153 is derived by removing a pair of rhombii 34 from the hexagon 68, and 154 is obtained by removing a pair of 34 from 67. Note that 153 has a rotational symmetry and 154 has a mirror symmetry. Similarly, for p=12, 49 is derived by removing 62 from the opposite ends of 40, and for p=14, 156 is derived by removing 65 from 73.

Figure 13:
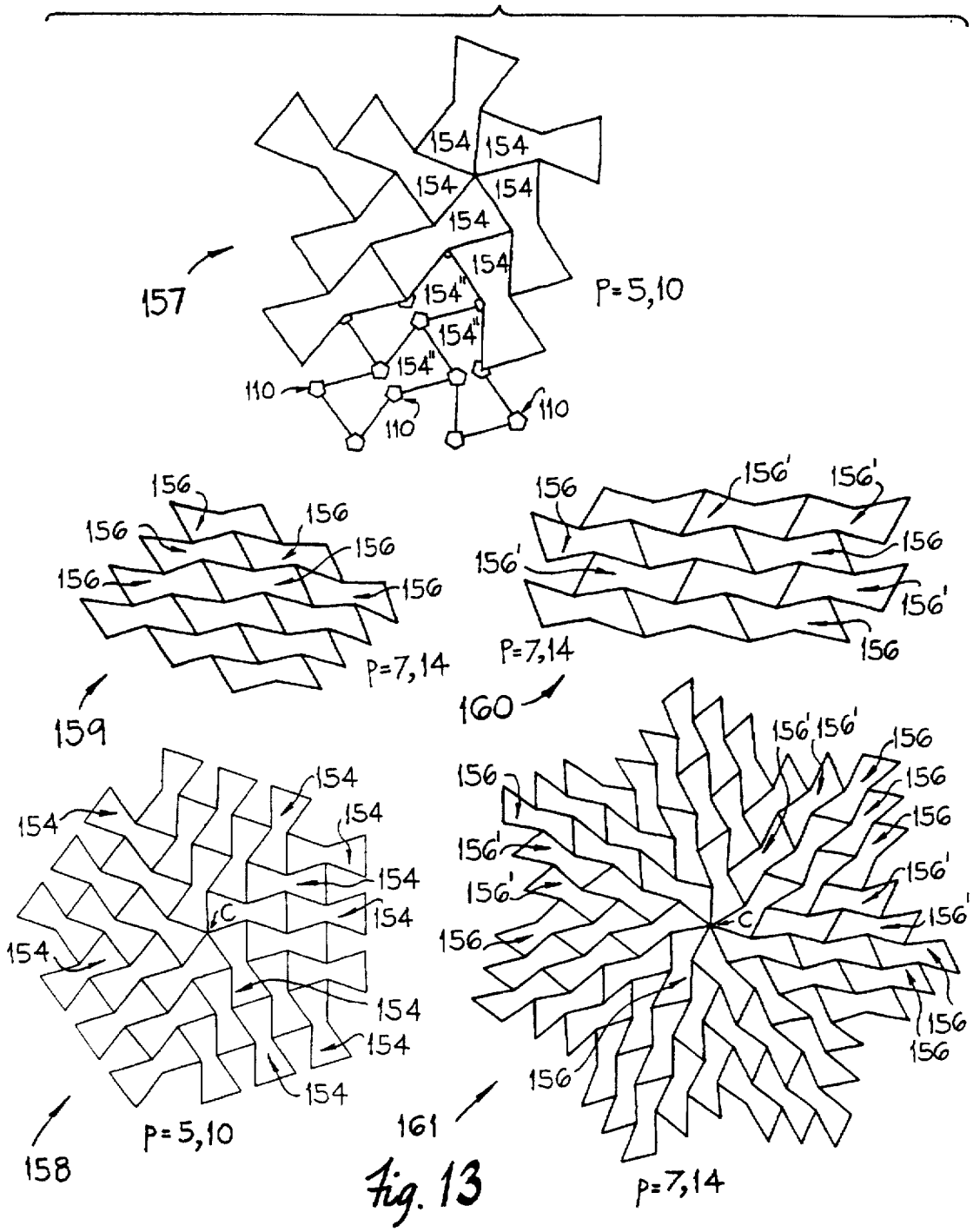
FIG. 13 shows examples of periodic, central and non-periodic tilings with biconcave hexagons.

FIG. 13 shows various tilings using biconcave hexagons. The tilings 157 and 158, p=5 or 10 cases, are similar and are composed of 154. Tiling 157 also shows the pentagonal nodes 110, and variant tiles 154" with cut-outs at the corners to accomodate the nodes; it is based on FIG. 10 of the parent application. Tiling 158 shows a 5-fold arrangement with central symmetry around C. Tilings 159 and 160, both p=7 or 14 cases, are periodic patterns using 156. Tiling 161, p=7 or 10, has a central 7-fold symmetry around C and is composed of 156.

Figure 14:
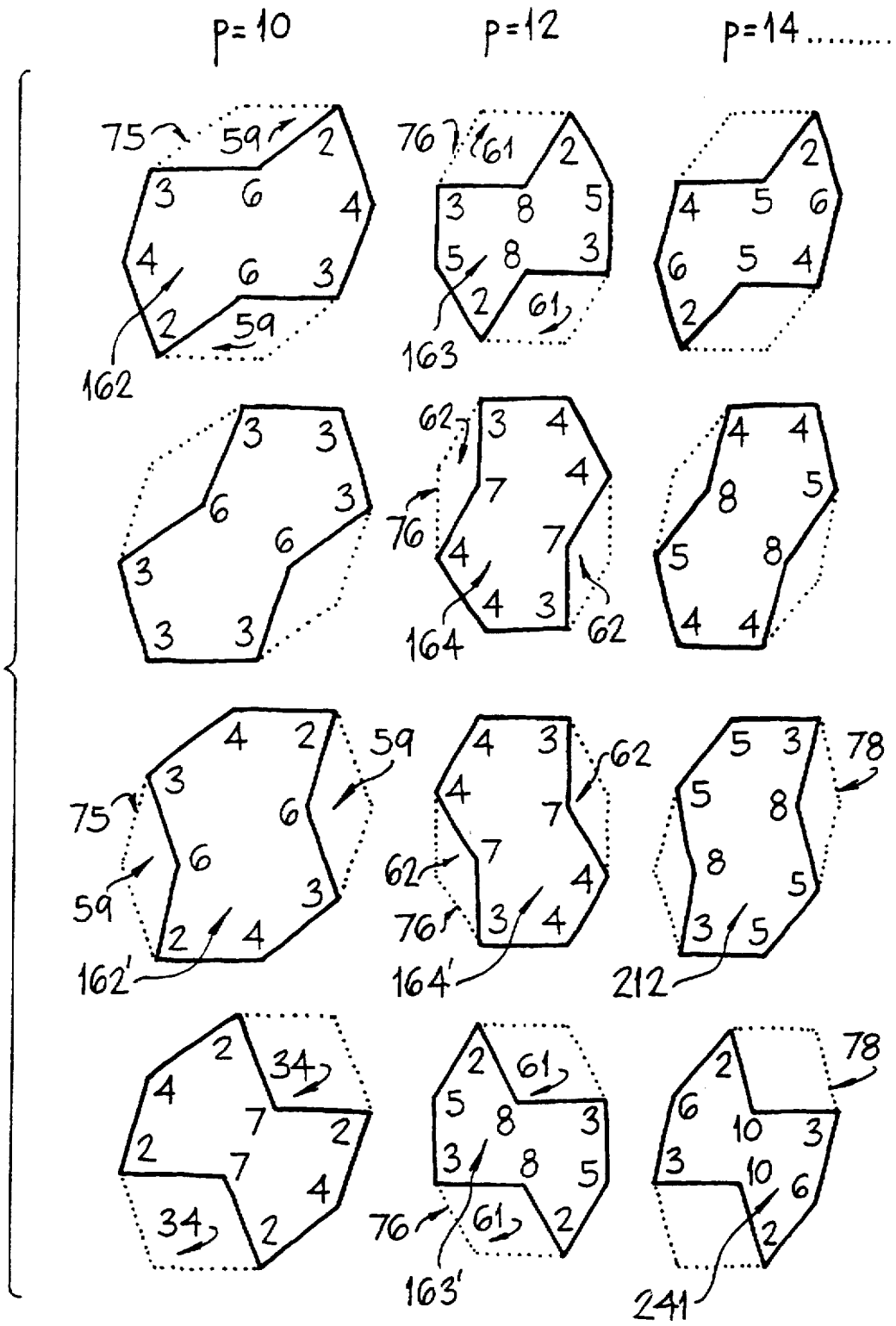
FIG. 14 shows a partial list of biconcave (doubly-concave) octagons with a 2-fold symmetry and two concave vertices obtained by removing two rhombii from the opposite sides of a convex octagon.

FIG. 14 shows biconcave (doubly-concave) octagons obtained by removing two rhombii of FIG. 4 from the opposite ends of octagons of FIG. 6. As in the case of biconcave hexagons, all bi-concave octagons here have a two-fold symmetry. Most of them possess a rotational symmetry while some have a mirror symmetry. The sum of angle-numbers equals 3 p. For each value of p, the various bi-concave octagons from the same convex octagons are shown. The octagons 162 and 162', p=10, are right- and left-handed versions obtained by removing a pair of rhombii 59 from a different pair of opposite ends of the convex octagon 75. In the p=12 case, the octagons 163 and 164 are obtained by removing pairs of 61 and 62 from 76; for each there exists an enantiomorph 163' and 164' as shown.

Figure 15:
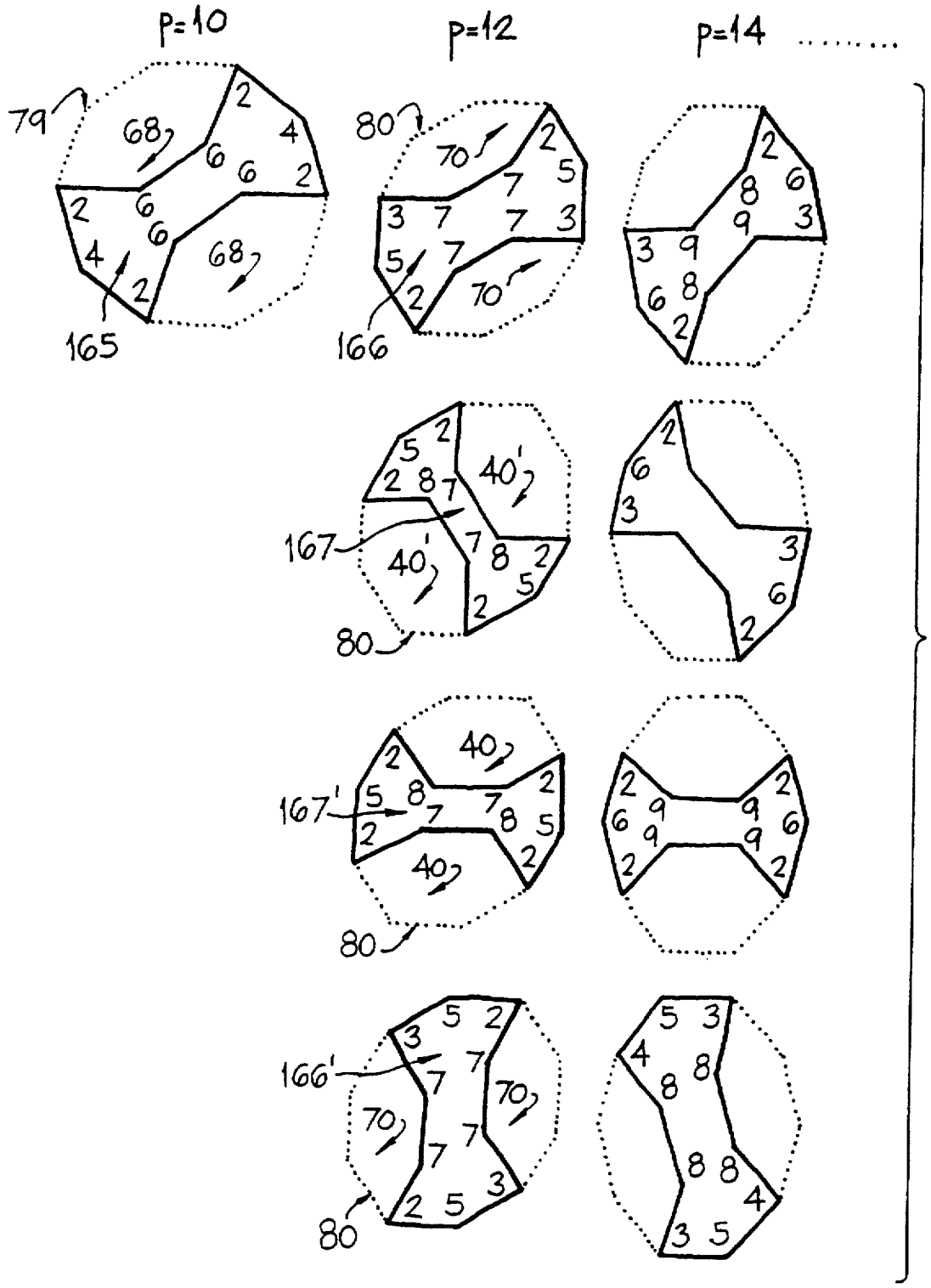
FIG. 15 shows a partial list of biconcave (doubly-concave) decagons with a 2-fold symmetry and four concave vertices obtained by removing two hexagons from the opposite sides of a convex decagon.

FIG. 15 shows biconcave decagons with a two-fold symmetry obtained by removing a pair of convex hexagons of FIG. 5 from the opposite sides of the convex decagons of FIG. 7. Here too, most examples have a rotational symmetry though some are mirror-symmetric. In each case, two opposite vertices are concave. The sum of the angle numbers in each equal 4 p. The decagon 165, p=10, is derived by subtracting a pair of 68 from the regular decagon 79. The decagons 166 and 167, p=12, are derived by subtracting the hexagons 70 and 40 from 80 as shown; both have their enantiomorphs 166' and 167'.

Figure 16:
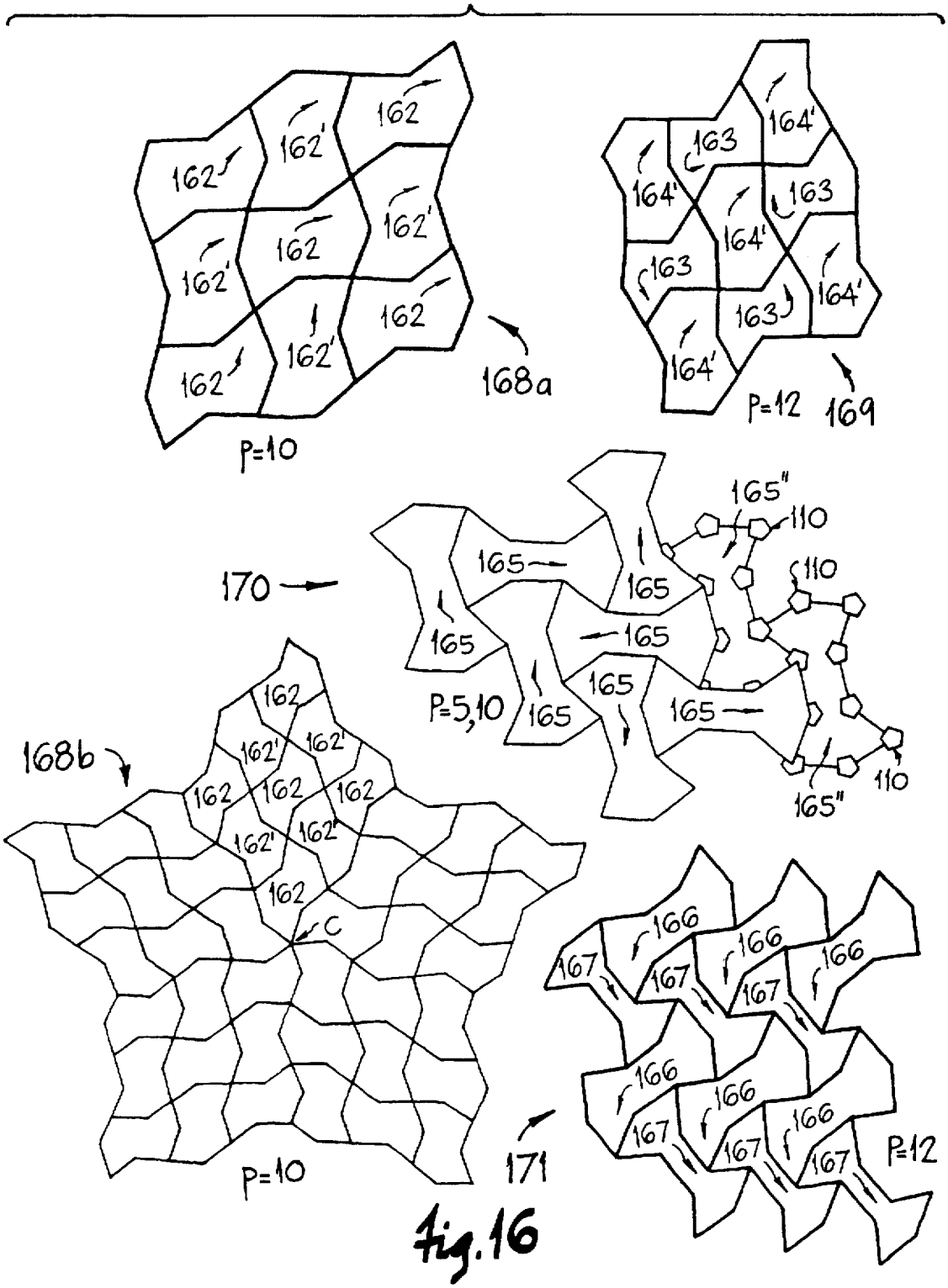
FIG. 16 shows examples of periodic and central tilings composed of bi-concave decagons with 2-fold symmetry.

FIG. 16 shows examples of tilings with biconcave polygons of FIGS. 14 and 15. Tiling 168*a*, p=10, is periodic and is composed of left- and right-handed octagons 162 and 162'. Tiling 168*b*, p=10, is composed of 162 and 162' and has a central 5-fold symmetry around C. The nine tiles which are shown numbered are identical to the tiling 168. Tiling 169, p=12, is also periodic, but is composed of two different octagons 163 and 164'. Tiling 170, p=5 or 10, is composed of biconcave decagons 165 arranged periodically. It has pentagonal nodes 110, and the infill tiles 165" are variants of 165; this tiling is based on FIG. 2 of the parent application. Tiling 171, p=12, is composed of two different bi-concave decagons 166 and 167, also arranged periodically.

Figure 17:
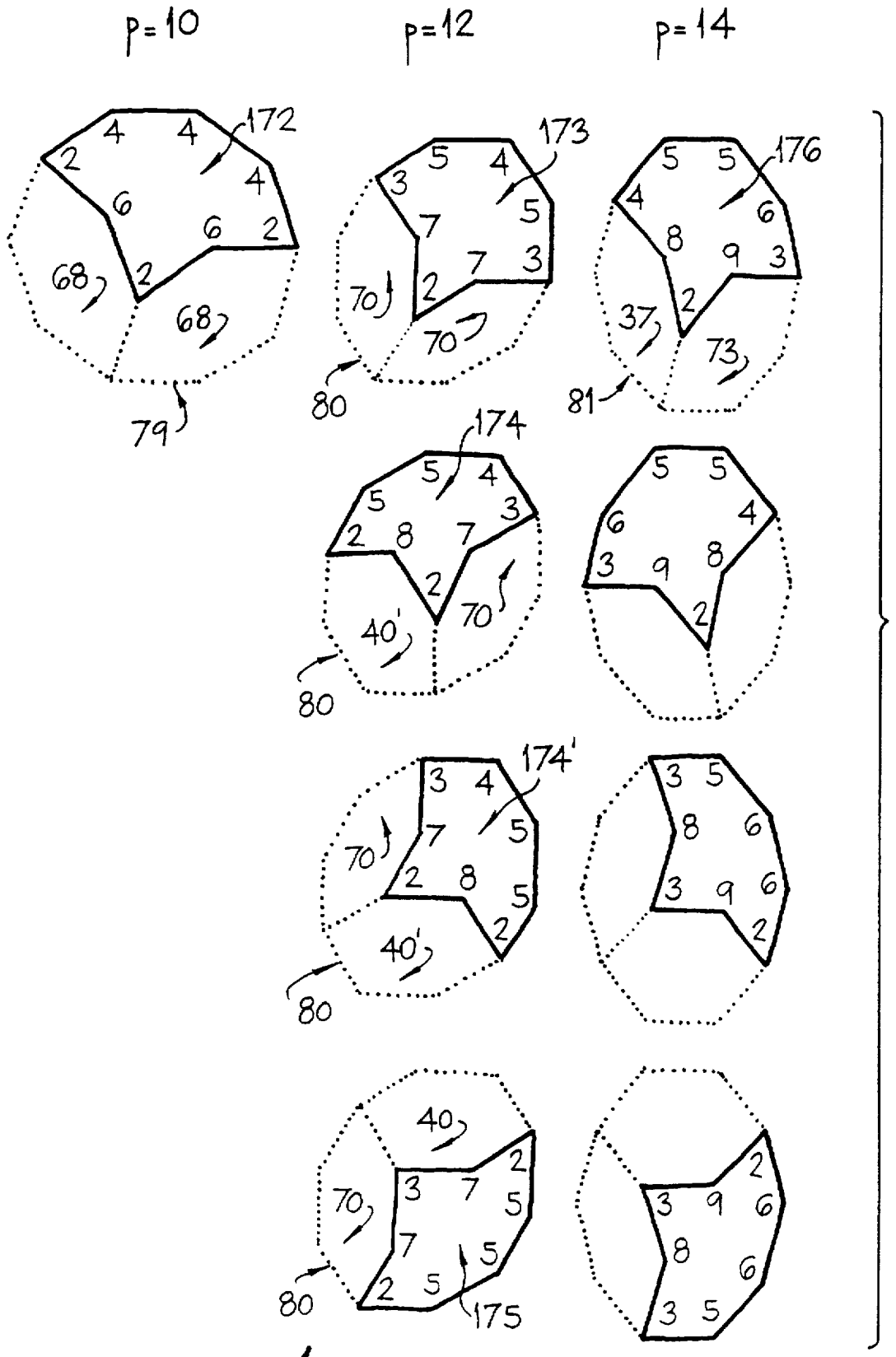
FIG. 17 shows a partial list of different types of biconcave octagons with two concave vertices, each either asymmetric or having a bilateral symmetry, and obtained by subtracting two adjacent hexagons from a decagon.

FIG. 17 shows a different class of bi-concave (doubly-concave) octagons obtained by removing two hexagons of FIG. 5 from the decagons of FIG. 7. The hexagons which are removed are adjacent to each other, thus resulting in either an asymmetrical or a bilaterally symmetric polygon. The two sets of concave vertices are also adjacent to each other. Compare FIG. 17 with FIG. 15: in both figures, two hexagons are removed, but the results are completely different. Here, each octagon has two concave vertices, and the sum of angle numbers equals 3 p. The octagon 172, p=10, is obtained by removing a pair of 68 from 79. The four octagons under p=12 are obtained by removing a pair of hexagons from the same decagon 80. 173 is obtained by removing a pair of 70, 174 and 174' are an enantiomorphic pair obtained by removing 40' and 70, and 175 is obtained by removing 40 and 70. The octagon 176, p=14, is obtained by removing 37 and 73 from 81.

FIG. 18 show two examples of asymmetric bi-concave decagons obtained by removing two different types of zonogons from a larger zonogon. These have two unequal sets pf concave vertices. Decagons 177 and 177', a left- and right-handed pair based on p=14, are obtained by removing two different zonogons from the dodecagon 84 of FIG. 8. 177 is obtained by removing 73' (the mirror image of 73, FIG. 5) and 43, and 177' is obtained by removing 78' (the mirror image of 78, FIG. 6) and 37 of FIG. 5. The sum of angle numbers in such bi-concave decagons equals 4 p.

FIG. 19 shows four examples of tilings using bilaterally symmetric or asymmetric bi-concave polygons. Tiling 178, p=5 or 10, is composed of 172 in a non-periodic arrangement and is based on FIG. 7 of the parent application. The pentagonal nodes 110 surround the tile 172", a variant of 172 obtained by modifying the corners of the tile to receive the pentagonal node-tile. Tiling 179, p=14, is a periodic tiling composed of 176. Tiling 180, p=12, is also periodic and is composed of 175 and 174'. Tiling 181, p=14, is a periodic tiling composed of 177.

Figure 20:
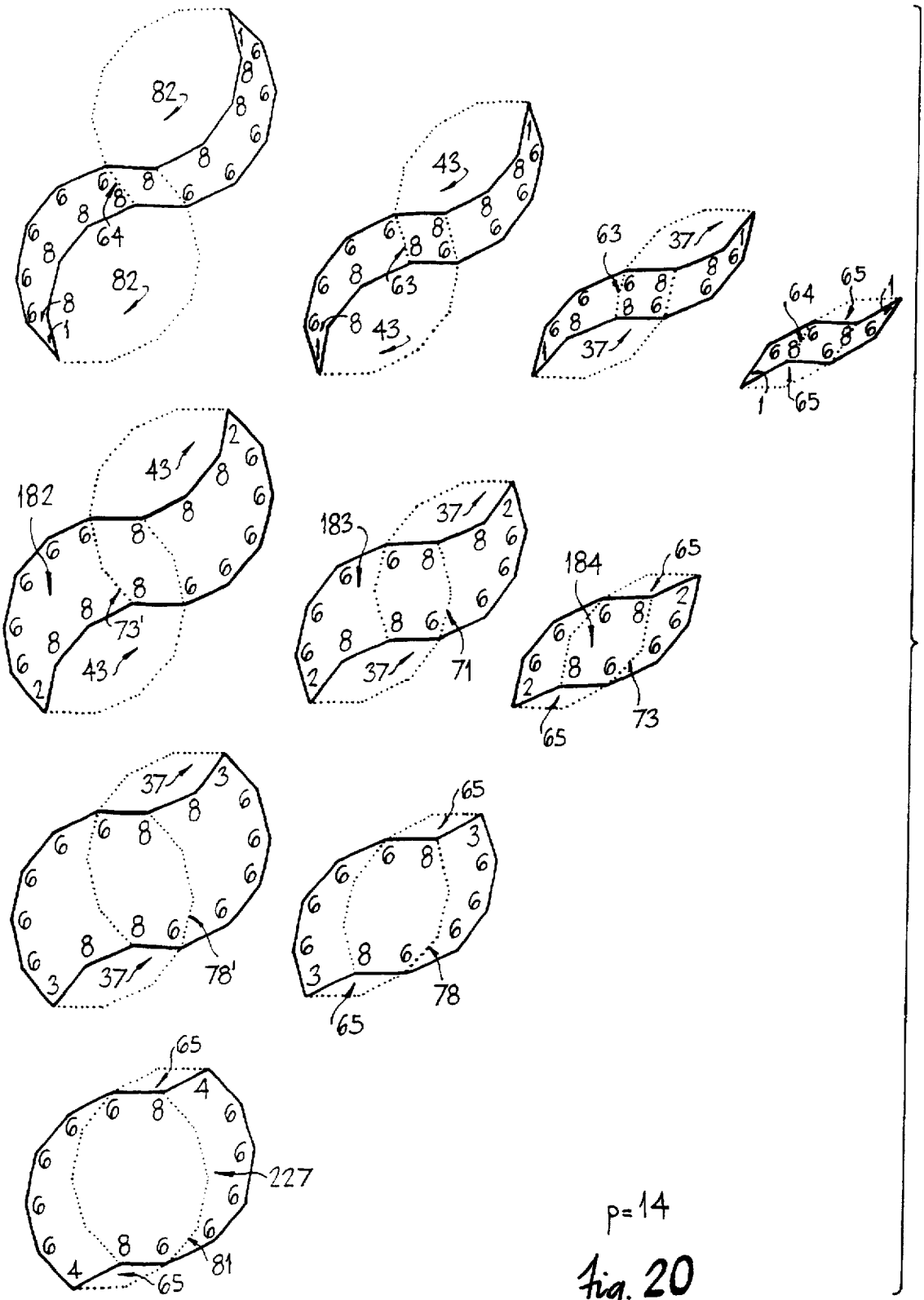
FIG. 20 shows a class of S-shaped polygonal tiles for p=14.

FIG. 20 shows a class of S-shaped tiles obtained by fusing two identical singly-concave (crescent-shaped) tiles in a two-fold rotational symmetry around a central tile. The central tile is a convex zonogon obtained by overlapping the ends of the two crescent tiles being fused. The tiles in FIG. 20 are shown for the p=14 case, and result from fusing two identical singly-concave tiles. For example, the S-shaped tile 183 is obtained by fusing two overlapping 10-sided asymmetric crescent-shaped tiles which share the central hexagon 71 in a 2-fold rotationally symmetric arrangement. The location of the two empty hexagons 37 on the opposite sides of the S-shaped tile shows the 2-fold symmetry. Similarly, the S-shape tile 184 is obtained by overlapping and fusing two 8-sided asymmetric crescent-shaped tiles around the central hexagon 73. The other S-shaped tiles can be derived similarly. All S-shaped tiles have two sets of concave vertices located in a 2-fold symmetrical arrangement with respect to each other and to the two sets of convex vertices which join them.

Alternatively, the S-shaped tiles can be obtained by fusing three differnt tiles, the central zonogonal tile and two singly-concave or doubly-concave tiles on either side in a 2-fold rotational manner.

Figure 21:
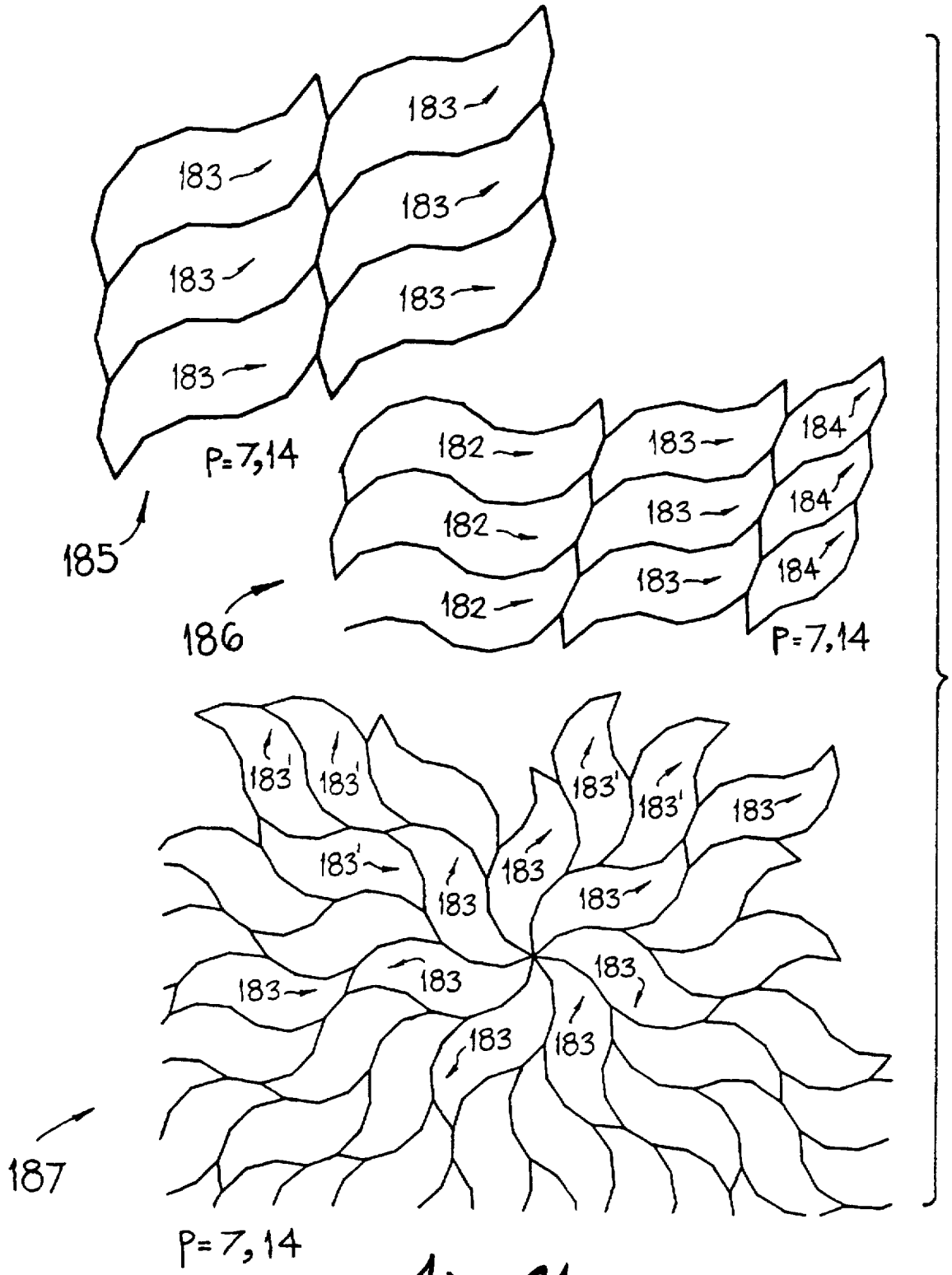
FIG. 21 shows tilings composed of S-shaped tiles.

FIG. 21 shows three examples of tilings with S-shaped tiles. Tiling 185, p=7 or 14, is a periodic tiling with tiles 183. Tiling 186 is composed of three different tiles, 182, 183 and 184. The three can be repeated periodically or alternated non-periodically. Tiling 187 is a tiling with central 7-fold symmetry and uses right- and left-handed S-shaped tiles 183 and 183'. It can be derived from p=7 or 14 nodes.

Figure 22:
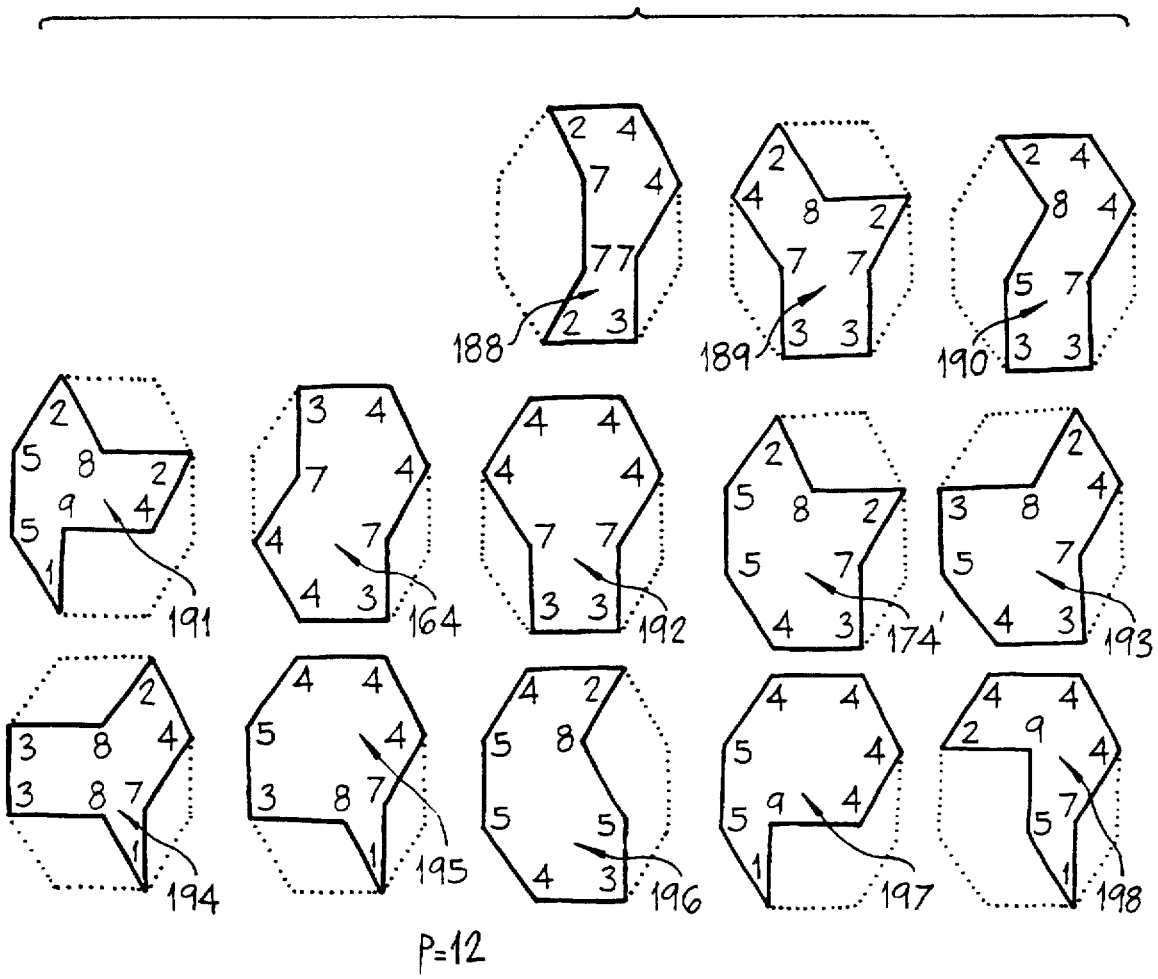
FIG. 22 shows an assortment of various tile shapes by subtracting rhombii and convex or singly-concave hexagons from an octagon of p=12.

FIG. 22 shows an assortment of non-convex polygons obtained from the octagon 76, p=12, by removing any combination of convex and non-convex polygons. The five polygons, namely, 164 (seen earlier in FIG. 14), 192, 174' (also seen earlier in FIG. 17), 193, 195 are doubly-concave octagons by removing two rhombii. 188 is obtained by removing a hexagon and a rhombus. 196 and 197 are obtained by removing a singly-concave hexagon. 190, 191, and 198 are obtained by removing a singly-concave hexagon and a rhombus. 189 and 194 are tri-concave (triply-concave) and are obtained by removing three different rhombii. The latter have three concave vertices. Other non-convex polygons can be similarly derived from other zonogons based on different values of p.

Figure 23:
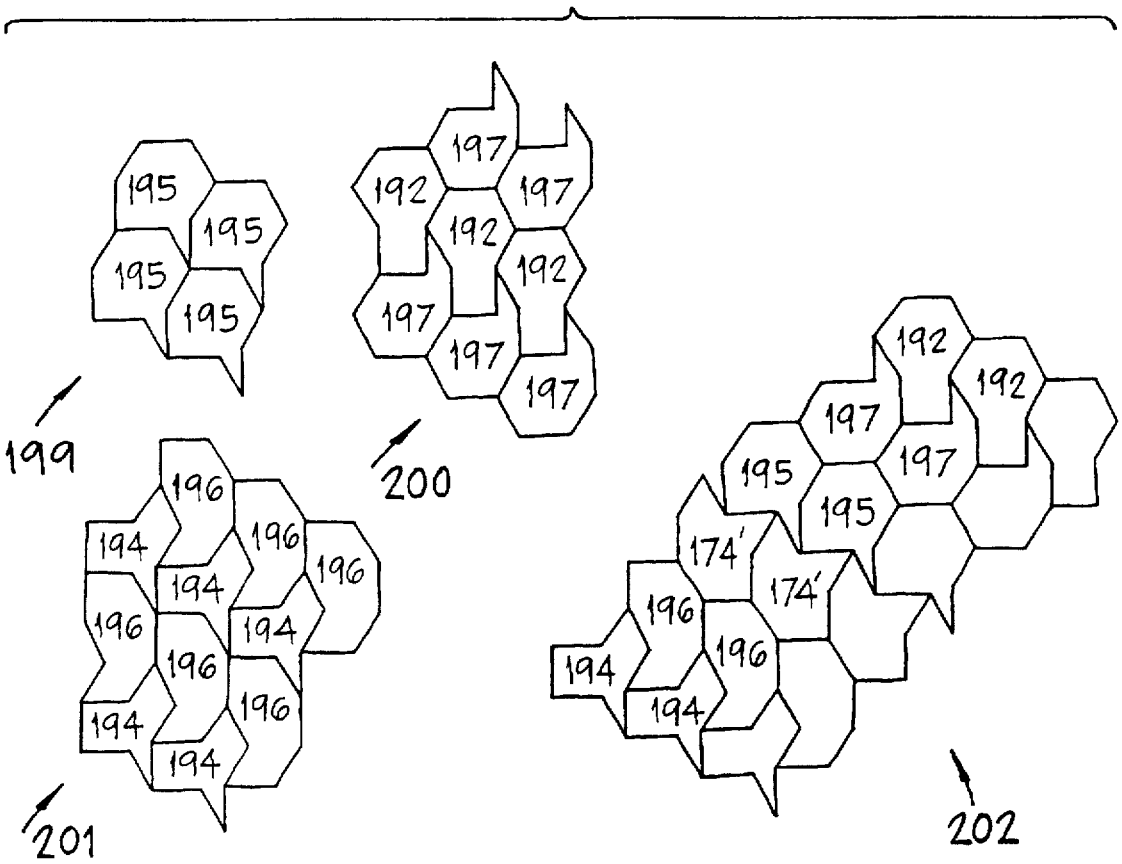
FIG. 23 shows examples of tilings using tiles from FIG. 22.

FIG. 23 shows examples of tilings composed of tiles from FIG. 22. Tiling 199 is a periodic tiling with 195. Tiling 200 is also a periodic tiling composed of 192 and 197. Tiling 201 is another periodic tiling composed of 194 and 196. Tiling 202 is a mixed tiling of six different tiles, 194, 196, 174', 195, 197 and 192. This particular tiling can be converted into a periodic or a non-periodic tiling by alternating successive pair of rows of tilings in a repeating or non-repeating manner.

Figure 24:
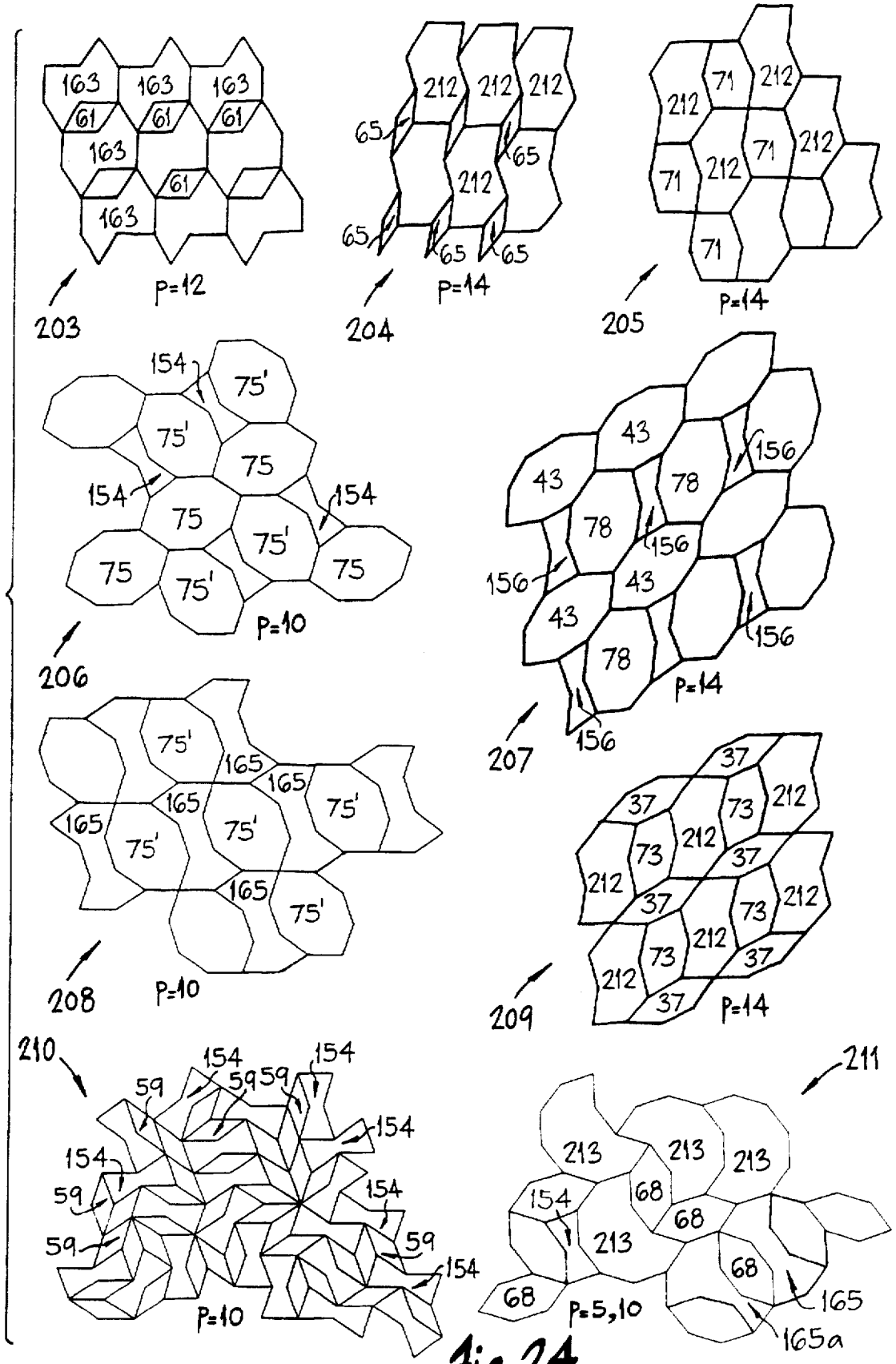
FIG. 24 shows examples of periodic and non-periodic tilings which combine convex and non-convex polygons.

The examples of tilings shown so far have been composed of either convex tiles or non-convex tiles. FIGS. 24 shows examples of tilings which combine both convex and non-convex tiles in one tiling configuration.

FIG. 24 shows seven examples of periodic tilings 203–209, and two examples of non-periodic tilings 210 and 211. Tiling 203, p=12, is composed of bi-concave octagons 163 and rhombii 61. Tiling 204, p=14, is composed of bi-concave octagons 212 and rhombii 65. Tiling 205, also p=14, is composed of bi-concave octagons 212 and convex hexagons 71. Tiling 206, p=10, is composed of convex octagons 75 and 75' (mirror image of 75) and bi-concave hexagon 154. Tiling 207, p=14, is composed of two different convex octagons 78 and 43, and bi-concave hexagon 156. Tiling 208, p=10, is composed of convex octagons 75' and bi-concave decagons 165. Tiling 209, p=14, is composed of bi-concave octagons 212, and two convex hexagons, 37 and 73. Tiling 210, p=10, is composed of bi-concave hexagons 154 and rhombii 59. Tiling 211, p=5 or 10, is composed of five different tiles: singly-concave tile 213, convex hexagon 68, the doubly-convex hexagon 154, and the doubly-concave decagons 165 and 165*a;* the tile 213 is crescent-shaped and is obtained by removing the hexagon 63 from the regular decagon 79.

Figure 25:
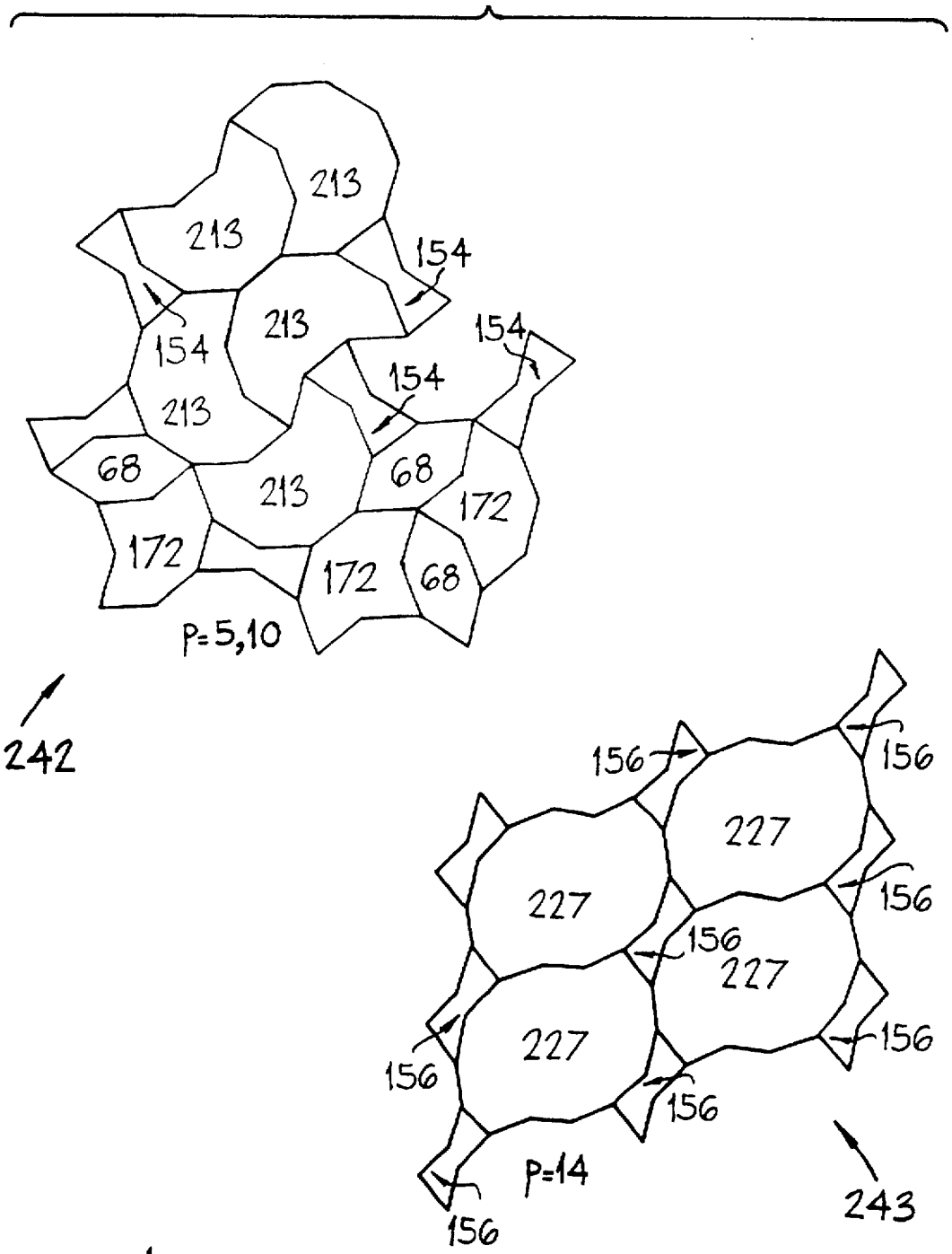
FIG. 25 shows various examples of periodic and non-periodic tilings which combine singly-concave tiles with doubly-concave tiles.

FIG. 25 shows a periodic and a non-periodic tiling composed of two or more different non-convex tiles. Tiling 242, p=5 or 10, is a non-periodic tiling and is composed of four different tiles each having mirror symmetry, a singly-concave crescent tile 213, a doubly-concave hexagon 154, a convex hexagon 68 and a doubly-concave octagon 172. Tiling 243, p=14, is a periodic tiling composed of bi-concave hexagons 156 and an S-shaped tile 227 of FIG. 20.

Figure 26:
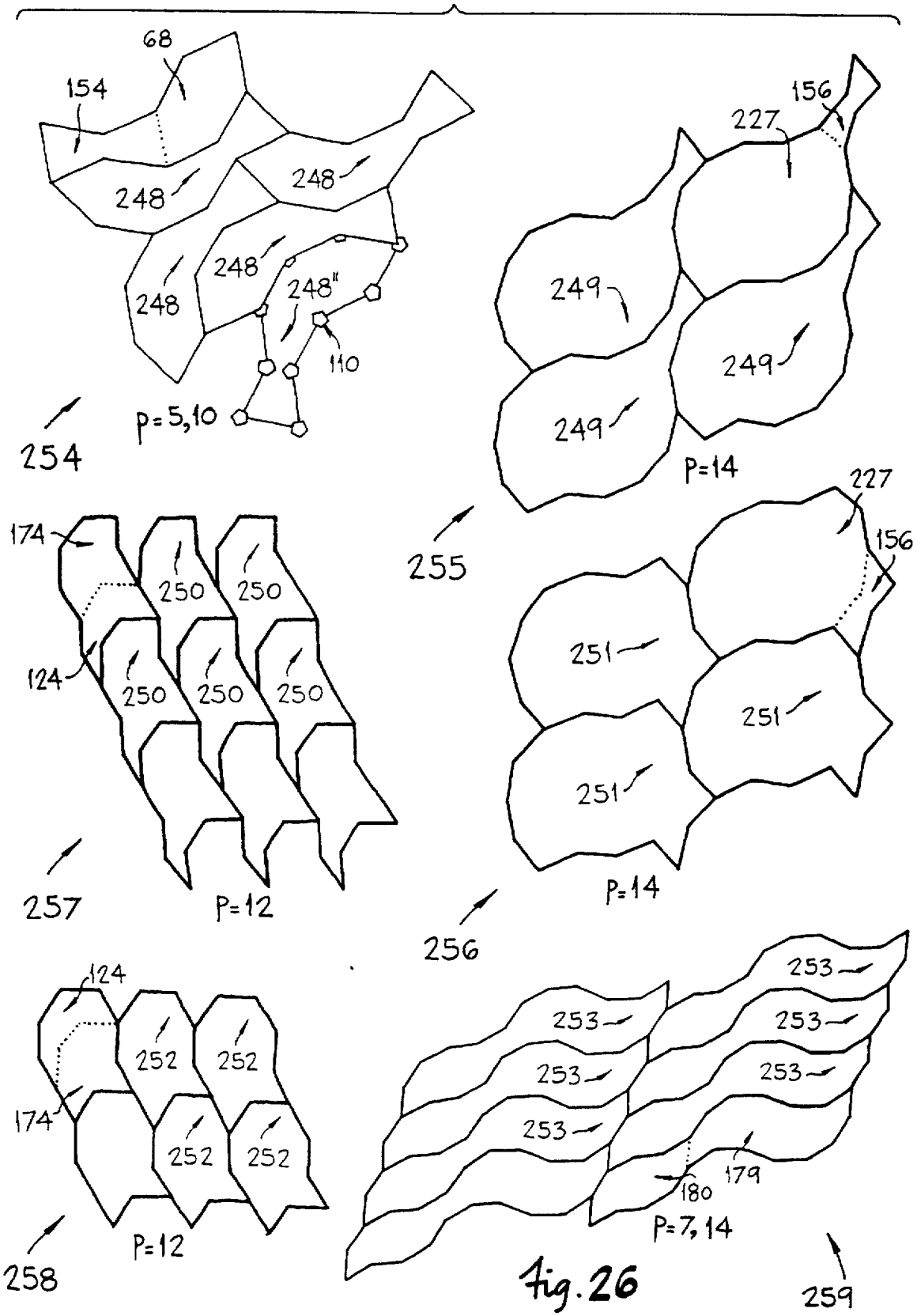
FIG. 26 shows complex polygonal tile shapes obtained by "fusing" two tiles into one. The tiles can be shaped to resemble living or imaginary creatures.

FIG. 26 shows examples of tiling patterns obtained by "fusing" two adjacent tiles into another. This technique suggests that Escher-like patterns can be obtained from polygonal tiles with specific angles determined by the value of p. Thus representational images from the natural, man-made or imaginary worlds can be "shaped" polygonally. For example, the tiling 254, p=5, is a non-periodic tiling composed of fish-like shapes 248, and is obtained by fusing the convex hexagon 68 with a non-convex hexagon 154. The pentagonal nodes 110, and the infill-tile 248" is shown alongside, and the tiling is based on FIG. 9 of the parent application; the tile 248 is doubly-concave. The tiling 255, p=14, a periodic tiling of polygons 249 suggesting drumsticks, is obtained by fusing 156 and the 227 (compare with tiling 243 from which it is derived); the drumstick-shaped tiles have three distinct sets of concave vertices, having one, two and three concave vertices, respectively. Tiling 256 is also derived from tiling 243 of FIG. 25 by fusing the same two polygons in a different way to obtain the shape 251 which has five distinct sets of concave vertices, each set having a single concave vertex. Tilings 257 and 258, p=12, are periodic tilings obtained by fusing the two tiles 174 and 124 in two ways to produce polygons 250 and 252. Tiles 250 are triply-concave, having three distinct sets of concave vertices, two of which have a single concave vertex and the third has two concave vertices; tiles 252 are doubly-concave. Tiling 259, p=7 or 14, is obtained by fusing two S-shaped tiles 179 and 180 to produce the sinuous shape 253; the tile 253 has four distinct sets of concave vertices, one with a single concave vertex, two with two concave vertices and one with three concave vertices. Similarly, other tilings with fused polygons can be derived. In each of the cases shown, the tiles could be converted into various creatures, fish, birds, etc.. Suitable markings and surface designs on the tiles can be added to enhance the representational meaning of the shape.

Variations of the tilings shown can be derived in many ways. These include decomposition of tiles into other tiles, dissections of convex and non-convex tiles, shaping the edges by curves or line segments, elongation or shrinkage of the edges, and deriving 3-dimensional prisms from the tiles. In addition, any type of markings on the surface of the tiles could be used to enhance the design or the geometry of the tiles, or to add surface features. These variations are shown in FIGS. 27–29.

Figure 27:
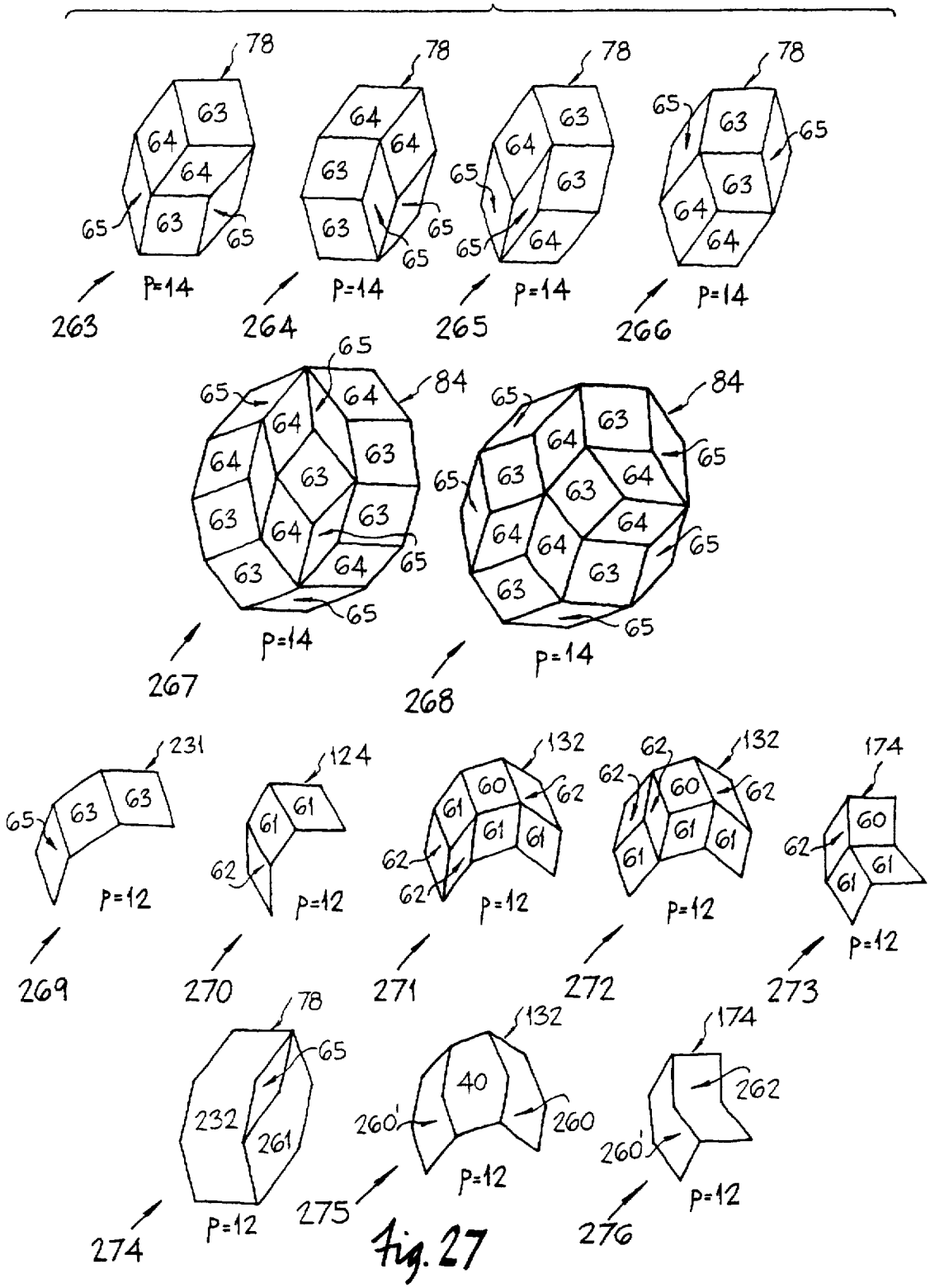
FIG. 27 shows the decomposition of various convex and non-convex polygons into rhombii and other convex and non-convex polygons.

FIG. 27 shows examples of convex and non-convex tiles decomposed into rhombii and other polygons. Examples include the decomposition of two convex zonogons and four non-convex polygons. Four decompositions of the convex octagon 78, p=14, are shown in 263–266, each composes of a pair of three different rhombii 63, 64 and 65. The dodecagon 84, p=14, is decomposed into fifteen rhombii, composed of five each of rhombii 63, 64 and 65, as shown with two examples in 267 and 268. The singly non-convex octagon 231, p=14, is decomposed into three rhombii, two of 63 and one of 64, as shown in 269. Similarly, the non-convex octagon 124, p=12, is decomposed into two of 61 and one of 62, as shown in 270. Two different decompositions of the non-convex decagon 132, p=12, into rhombii 60, 61 and 62, is shown in 271 and 272. The doubly-convex octagon 174, p=12, composed of four rhombii is shown in 273. The convex octagon 78, p=14, is decomposed into two different singly-convex polygons 232 and 261 and a rhombus 65, as shown in 274. The non-convex decagon 132, p=12, is decomposed into a convex hexagon 40 and two non-convex hexagons 260 and 260', as shown in 275. The non-convex octagon 174 is decomposed into two non-convex hexagons 260' and 262, as shown in 276.

Figure 28:
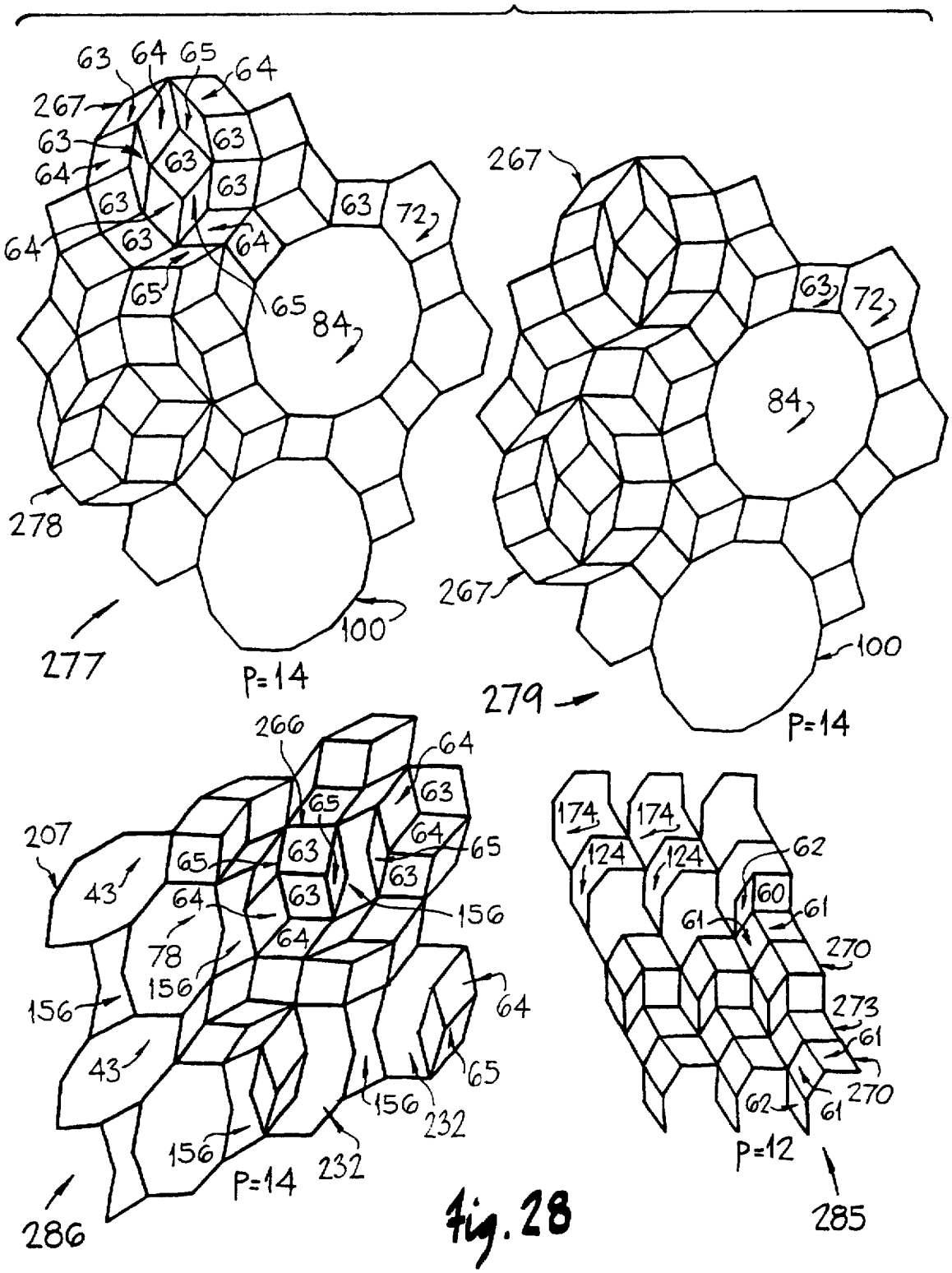
FIG. 28 shows periodic and non-periodic tilings obtained by decomposing non-rhombic periodic and non-periodic tilings into rhombii.
Figure 29:
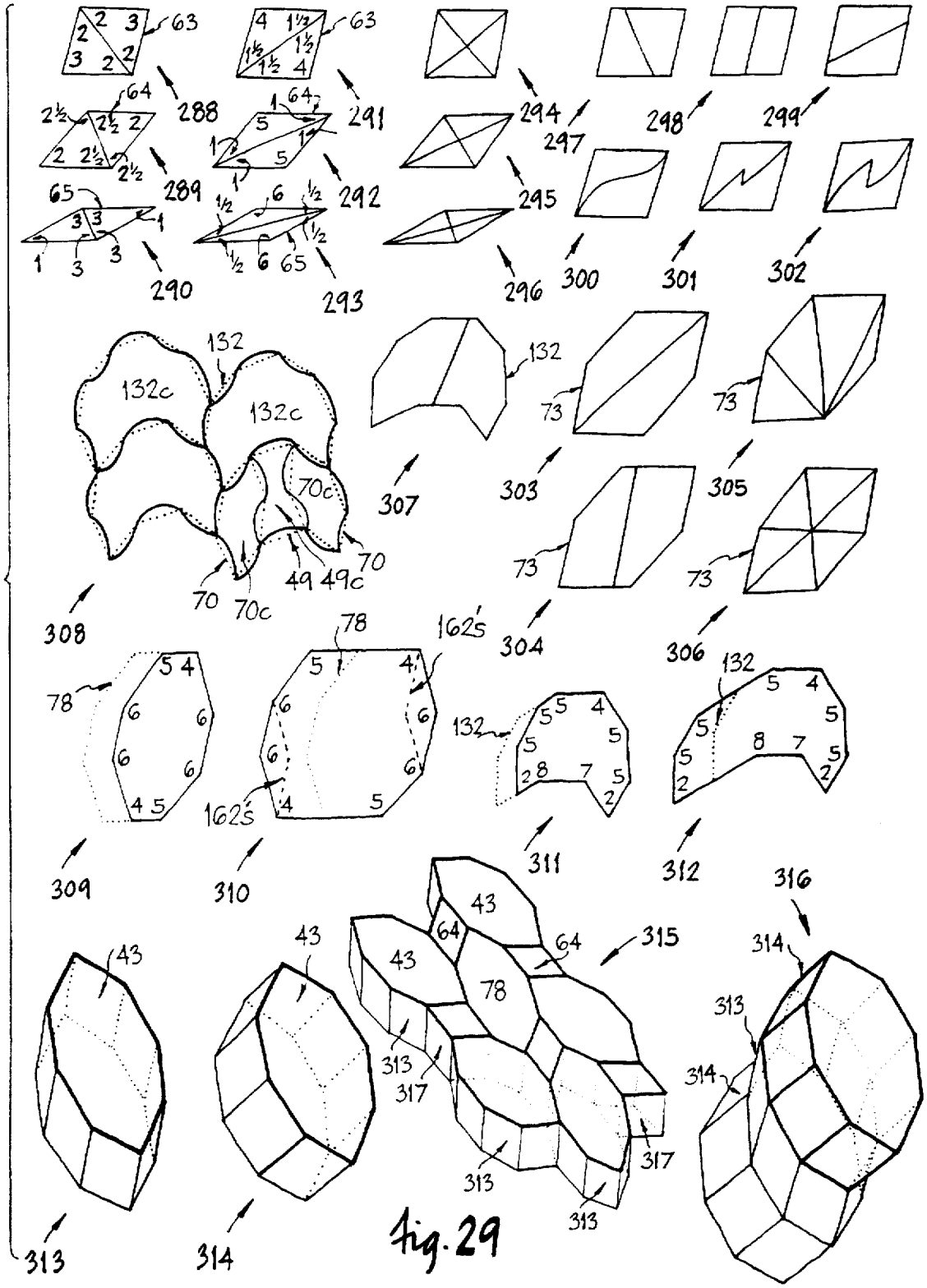
FIG. 29 shows techniques of dissections, curving edges, stretching or shortening of sides for deriving variants of equi-edged tiles. 3-dimensional extensions of tilings into space-filling prisms and blocks is also shown.

FIG. 28 shows tilings obtained by decomposing individual tiles of a few periodic and non-periodic tilings shown earlier. In all examples, only a portion of the tiling is shown decomposed.

Tilings 277 and 279 are decompositions of the periodic tiling 100 of FIG. 10. When all dodecagons 84 are decomposed alike, say as 267, the periodic rhombic tiling 279 is obtained. When the dodecagons are decomposed differently, the non-periodic rhombic tiling 277 is obtained; here the two different dodecagons are 267 and 284. Further, in 279, the hexagons 72 are decomposed alike, while in 277, the hexagons may or may not be decomposed alike.

Tiling 285, p=12, is a periodic tiling composed of singly-concave tiles 124 and doubly-concave tiles 174 (see upper portion of the illustration). The decomposition of these two tiles into convex (rhombic) tiles 270 and 273, respectively, (in the lower portion of the illustration) suggests the possibility of a tiling with singly-concave, doubly-concave and convex tiles. Depending on the decomposition, it could be periodic or non-periodic.

Non-periodic tiling 286, p=14, is based on the periodic tiling 207 of FIG. 24 and composed of convex octagons 43 and 78, and the doubly-concave hexagon 156. After decomposition, the hexagons 156 remain unchanged, while the octagons are decomposed in different ways as shown. Three different decompositions of the octagon 78 can be seen; on the bottom right, it is decomposed into singly-concave octagons 232 and rhombuses 64 and 65. The octagon 43 is similarly decomposed in four different ways. This suggests another example of a tiling with convex, singly-concave and doubly-concave tiles and can be periodic or non-periodic.

The techniques of decomposition of periodic and non-periodic tilings can be applied to all tilings where the polygons can be decomposed into smaller tiles. For example, all tilings of convex polygons shown in FIGS. 9 and 10 can be decomposed into smaller convex tiles, singly-concave tiles, doubly-concave or multiply-concave tiles, and any of their combinations. Similarly, the tilings in FIGS. 16, 19, 21, 23 and 24 can be decomposed into combinations of convex and non-convex tiles. Some of the decompositions are suggested by the dotted lines in FIGS. 11, 12, 14, 15, 17, 18, 20 and 22.

In summary, for a fixed value of p, all convex zonogons (including even-sided regular polygons) shown in part in FIGS. 4–8, even-sided singly-concave tiles (FIG. 11), even-sided doubly-concave tiles (FIGS. 12, 14, 15, 17, 18 and 20) and even-sided multiply-concave tiles (part of FIG. 22), can be mixed and matched with each other in a large number of combinations. In addition, some tiles can tile by themselves. The tiling rule is simple: the sum of angle-numbers at a vertex must add up to p. The tiling configurations could be periodic or non-periodic, with or without rules. From the tilings illustrated herein, other tilings can be derived by dissecting each tile into smaller convex and/or non-convex tiles (as per FIG. 27 and FIGS. 11, 12, 14, 15, 17, 18, 20 and 22 illustrating the derivation of non-convex tiles from convex zonogons). Further, for each combination of tiles, different tiling configurations are possible by re-arranging the same tiles.

FIG. 29 show various ways of extending the scope of the application. All convex and non-convex polygons described so far can be dissected into two or more parts by straight or curved lines. Unlike the decompositions described in FIG. 27, here the lines of dissections may be arbitrary. The angle-numbers of the dissected pieces in such cases are no longer integers.

All rhombii of FIG. 4 can be dissected into two equal parts by the diagonal as shown in 288–293 for the three rhombii 63–65 of p=14. When both diagonals are used, the rhombus is diviided into four right-angled triangles as shown in 294–296. The lines of dissections need not pass through the vertices as in 297–299. Curved diagonals, or several line segments could be used to divide the rhombus into two equal or unequal parts. 300–302 show three examples.

Similarly all higher zonogons shown in FIGS. 4–7 can be dissected into two or more parts. An example is shown with the hexagon 73, p=14. In 303 and 304 it is dissected into two equal parts, in 305 it is divided into four different pieces, in 306 it is divided into six triangles. One example of a dissection of a non-convex polygon is shown in 307 with the decagon 132, p=12. All other singly-concave, doubly-concave and multiply-concave tiles can be similarly dissected.

The edges of the tiles can be curved in various ways. In 308, the periodic tiling of singly-concave crescents 132, p=12, and shown in dotted lines, is transformed by changing the tile 132 to 132*c* with curved edges. The tiles with curved edges have the same area as the original tiles. The tile on the bottom right is decomposed into two convex hexagons 70 and a doubly-concave hexagon 49, shown in dotted line. These have been transformed into tiles 70*c* and 49*c* by curving the edges as shown. Similarly, all convex, singly-concave and doubly-concave tiles can be replaced by corresponding tiles with curved edges but same area.

The individual tiles can be stretched or elongated in one or more directions, keeping all the angle-numbers unchanged. As an example, the convex tile 78, p=14, is shrunk to 309 and elongated to 310. Similarly, the non-convex tile 132 is shrunk to 311 and elongated to 312. In all four examples, the dotted line shows the boundary of the original tile. In 310, the stretching of the doubly-concave octagon 162' to 162's is also indicated by the dotted lines.

All convex and non-convex tiles described in this application can be converted into prismatic (polyhedral) blocks of any height by increasing the thickness of the tile. This was already described in FIGS. 15–18 of the parent application, though in a different way. As an example, the convex tile 43, p=14, is raised to an upright prism 313, or an inclined prism 314. The periodic array 315 of upright prisms 313 and 317 is similarly based on the tiling 98 of FIG. 10. The prisms can be stacked in multi-layers 316 as shown with prisms 313 and 314. Similarly, space-filling layers of convex and non-convex prisms can be derived from all the tilings described in this application.

When the prisms are constructed hollow, architectural spaces are possible. The faces of the prisms can be constructed as prefabricated panels of any suitable material, or cast in one piece, and held in place with suitable connection devices and joining details. The walls could be load-bearing surfaces or structurally free as infill panels. Suitable openings can be introduced in the walls, floors or ceilings, to permit a spatial link between adjoining spaces. The vertical and inclined edges could be converted into load-bearing columns and the horizontal edges into structural beams, providing an alternative to the node-and-strut system already described in the parent application. Alternatively, all edges could be constructed as a rigid frame structure, with non-loadbearing walls introduced. The rigid frames could be converted into arches or trusses as other variants of building systems based on the invention.

Though selected examples and preferred embodiments have been described, it will be clear to those skilled in the art that various modifications can be made without departing from the scope of the invention.

What is claimed is:

1. A tiling kit, the combination comprising:

a plurality of substantially planar, even-sided non-convex polygonal tiles, each of said tiles having m edges which meet at m vertices at interior angles defined by an angle between adjacent edges on an interior of said tile, where said edges are composed of m/2 pairs of parallel edges and where m is greater than 4, and wherein said interior angles comprise two different sets of angles, a first set of angles comprising at least two distinct and separate sets of contiguous concave angles greater than 180°, each set of concave angles further comprising at least one said concave angle, and a second set of angles comprising at least two distinct and separate sets of contiguous convex angles less than 180°, each set of convex angles further comprising at least one convex angle, and where each set of said first set of angles is joined to another set of said first set of angles by a set of said second set of angles, said tiles are engaged together to fill a substantially planar surface, said edges are substantially equal in length and said interior angles are integer multiples of angle A, where A equals 360°/p, and the sum of all said interior angles of each tile equals ((m−2)/2)p multiplied by A, and where p is any number greater than 6.

2. A tiling kit, the combination comprising:

a plurality of substantially planar, even-sided polygonal tiles, each of said tiles having m edges which meet at m vertices at interior angles defined by an angle between adjacent edges on an interior of said tile, where said edges are composed of m/2 pairs of parallel edges, and wherein said plurality of tiles comprises non-convex tiles with m greater than 4 and convex tiles with m greater than 2, said interior angles of said non-convex tiles comprise two different sets of angles, a first set of angles comprising at least two distinct and separate sets of contiguous concave angles greater than 180°, each set of concave angles further comprising at least one concave angle, and a second set of angles comprising at least two distinct and separate sets of contiguous convex angles less than 180°, each set of convex angles further comprising at least one convex angle, and where each set of said first set of angles is joined to another set of said first set of angles by a set of said second set of angles, said tiles are engaged together to fill a substantially planar surface, said edges are substantially equal in length and said interior angles are integer multiples of angle A, where A equals 360°/p, and the sum of all said interior angles of each tile equals ((m−2)/2)p multiplied by A, and where p is any number greater than 6.

3. A tiling kit, the combination comprising a plurality of substantially planar, even-sided polygonal tiles, each of said tiles having m edges which meet at m vertices at interior angles defined by an angle between adjacent edges on an interior of said tile, where said edges are composed of m/2 pairs of parallel edges and where m is greater than 4, and wherein said plurality of tiles comprises non-convex tiles with m greater than 4, singly-concave tiles with m greater than 4 and convex tiles with m greater than 2, said interior angles of said non-convex tiles comprise two different sets of angles, a first set of angles comprising at least two distinct and separate sets of contiguous concave angles greater than 180°, each set of concave angles further comprising at least one concave angle, and a second set of angles comprising at least two distinct and separate sets of contiguous convex angles less than 180°, each set of convex angles further comprising at least one convex angle, and where each set of said first set of angles is joined to another set of said first set of angles by a set of said second set of angles, said interior angles of said singly-concave tiles comprise two different sets of angles, a first set of angles comprising a set of contiguous concave angles greater than 180°, said set of concave angles further comprising at least one concave angle, and a second set of angles comprising a set of contiguous convex angles less than 180°, where said first set of angles of said interior angles of said singly-concave tiles is joined to said second set of angles of said interior angles of said singly-concave tiles through two additional convex angles, said tiles are engaged together to fill a substantially planar surface, said edges are substantially equal in length and said interior angles are integer multiples of angle A, where A equals 360°/p, and the sum of all said interior angles of each tile equals ((m−2)/2)p multiplied by A, and where p is any number greater than 6.

4. A tiling kit, the combination comprising:

a plurality of substantially planar, convex polygonal tiles, each of said tiles having m edges which meet at m vertices at interior angles defined by an angle between adjacent edges, where said edges are composed of m/2 pairs of parallel edges and m is an even number greater than 2, and wherein the number of said edges of said tiles in said plurality comprise even numbers ranging from 4 through m, said tiles are engaged together to fill a substantially planar surface, said edges are substantially equal in length and said interior angles are integer multiples of angle A, where A equals 360°/p, and the sum of all said interior angles of each tile equals ((m−2)/2)p multiplied by A, and where p is any number greater than 6.

5. Tiling kit as per claim 1, used in configurations selected from the group comprising:

configurations which are periodic, configurations which are periodic in one direction and non-periodic in another direction, configurations which have an overall p-fold symmetry around a center, configurations which have no translational symmetry in any direction.

6. Tiling kit as per claim 1, wherein said tiles are upright or inclined prisms of any height, wherein said prisms make space-filling 3-dimensional polyhedral blocks.

7. Tiling kit as per claim 1, wherein said tiles are modified by dissections selected from the group comprising:

dissection of said tiles into two or more parts, decomposition of said tiles into rhombii with interior angles which are also integer multiples of A, and where the sum of the interior angles of each rhombus equals p multiplied by A, decomposition of said tiles into convex and non-convex polygonal tiles with interior angles which are also integer multiples of A.

8. Tiling kit as per claim 1, wherein said tiles in said plurality are modified by replacing said edges of tiles by curved line segments such that the area of the tile remains unchanged.

9. Tiling kit as per claim 1, wherein said tiles in said plurality are modified by elongating or shrinking said edges of tiles in one or more directions.

10. Tiling kit as per claim 1, wherein said non-convex tiles are S-shaped tiles.

11. Tiling kit as per claim 1, wherein said non-convex tiles resemble shapes of natural or human-made objects and creatures.

12. Tiling kit as per claim 2, used in configurations selected from the group comprising:

configurations which are periodic, configurations which are periodic in one direction and non-periodic in another direction, configurations which have an overall p-fold symmetry around a center, configurations which have no translational symmetry in any direction.

13. Tiling kit as per claim 2, wherein said tiles are upright or inclined prisms of any height, wherein said prisms make space-filling 3-dimensional polyhedral blocks.

14. Tiling kit as per claim 2, wherein said tiles are modified by dissections selected from the group comprising:

dissection of said tiles into two or more parts, decomposition of said tiles into rhombii with interior angles which are also integer multiples of A, and where the sum of the interior angles of each rhombus equals p multiplied by A, decomposition of said tiles into convex and non-convex polygonal tiles with interior angles which are also integer multiples of A.

15. Tiling kit as per claim 2, wherein said tiles in said plurality are modified by replacing said edges of tiles by curved line segments such that the area of the tile remains unchanged.

16. Tiling kit as per claim 2, wherein said tiles in said plurality are modified by elongating or shrinking said edges of tiles in one or more directions.

17. Tiling kit as per claim 3, used in configurations selected from the group comprising:

configurations which are periodic, configurations which are periodic in one direction and non-periodic in another direction, configurations which have an overall p-fold symmetry around a center, configurations which have no translational symmetry in any direction.

18. Tiling kit as per claim 3, wherein said tiles are upright or inclined prisms of any height, wherein said prisms make space-filling 3-dimensional polyhedral blocks.

19. Tiling kit as per claim 3, wherein said tiles are modified by dissections selected from the group comprising:

dissection of said tiles into two or more parts, decomposition of said tiles into rhombii with interior angles which are also integer multiples of A, and where the sum of the interior angles of each rhombus equals p multiplied by A, decomposition of said tiles into convex and non-convex polygonal tiles with interior angles which are also integer multiples of A.

20. Tiling kit as per claim 3, wherein said tiles in said plurality are modified by replacing said edges of tiles by curved line segments such that the area of the tile remains unchanged.

21. Tiling kit as per claim 3, wherein said tiles in said plurality are modified by elongating or shrinking said edges of tiles in one or more directions.

22. Tiling kit as per claim 3, wherein said tiles are fused to one another to resemble shapes of natural or human-made objects and creatures.

23. Tiling kit as per claim 4, wherein said tiles are upright or inclined prisms of any height, wherein said prisms make space-filling 3-dimensional polyhedral blocks.

24. Tiling kit as per claim 4, wherein said tiles are modified by dissections selected from the group comprising:

dissection of said tiles into two or more parts, decomposition of said tiles with m greater than 6 into rhombii with interior angles which are also integer multiples of A, and where the sum of the interior angles of each rhombus equals p multiplied by A, decomposition of said tiles into convex and non-convex polygonal tiles with interior angles which are also integer multiples of A.

25. Tiling kit as per claim 4, wherein said tiles in said plurality are modified by replacing said edges of tiles by curved line segments such that the area of the tile remains unchanged.

26. Tiling kit as per claim 4, wherein said tiles in said plurality are modified by elongating or shrinking said edges of tiles in one or more directions.

27. Tiling kit as per claim 4, wherein said tiles are fused to one another to resemble shapes of natural or human-made objects and creatures.

* * * * *